US008579001B2

(12) United States Patent
Sakamoto

(10) Patent No.: US 8,579,001 B2
(45) Date of Patent: Nov. 12, 2013

(54) TAPE FEEDING DEVICE AND TAPE APPLICATOR

(76) Inventor: Eizo Sakamoto, Kyoto (JP)

( * ) Notice: Subject to any disclaimer, the term of this patent is extended or adjusted under 35 U.S.C. 154(b) by 0 days.

(21) Appl. No.: 13/527,277

(22) Filed: Jun. 19, 2012

(65) Prior Publication Data

US 2012/0279664 A1 Nov. 8, 2012

Related U.S. Application Data

(63) Continuation-in-part of application No. PCT/JP2010/071157, filed on Nov. 26, 2010.

(30) Foreign Application Priority Data

Dec. 28, 2009 (JP) ..... 2009-298872

(51) Int. Cl.
*B65H 35/07* (2006.01)
*B32B 37/10* (2006.01)

(52) U.S. Cl.
USPC ..... 156/577; 156/579; 225/16

(58) Field of Classification Search
USPC ..... 156/574, 577, 579; 225/10, 11, 16
See application file for complete search history.

(56) References Cited

U.S. PATENT DOCUMENTS

| | | | | |
|---|---|---|---|---|
| 272,436 | A * | 2/1883 | Heffernan | 156/523 |
| 2,720,262 | A * | 10/1955 | Hanson | 225/24 |
| 3,466,963 | A * | 9/1969 | Hawes et al. | 83/226 |
| 3,686,055 | A * | 8/1972 | Hermann | 156/384 |
| 3,935,751 | A * | 2/1976 | Lee | 474/50 |
| 5,048,737 | A * | 9/1991 | Sueda et al. | 225/11 |
| 6,098,690 | A * | 8/2000 | Robichaud | 156/577 |
| 6,165,087 | A * | 12/2000 | Iammatteo et al. | 474/7 |
| 7,069,972 | B1 * | 7/2006 | Edelstein | 156/767 |
| 2004/0099380 | A1 * | 5/2004 | Ho | 156/577 |
| 2007/0194165 | A1 * | 8/2007 | Lee | 242/411 |
| 2008/0083487 | A1 * | 4/2008 | Moss et al. | 156/250 |

FOREIGN PATENT DOCUMENTS

| | | |
|---|---|---|
| CA | 2008822 | 7/1990 |
| JP | 61-56361 | 4/1986 |
| JP | 62-161140 | 10/1987 |
| JP | 3-113357 | 11/1991 |
| JP | 4-26966 | 3/1992 |
| JP | 4-503046 | 6/1992 |
| JP | 09-194116 | 7/1997 |

(Continued)

OTHER PUBLICATIONS

Microfilm of the specification and drawings annexed to the request of Japanese Utility Model Application No. 21653/1990 (Laid-open No. 113357/1991) (Kyushi Hitachi Maxell, Ltd.) Nov. 19, 1991.

(Continued)

*Primary Examiner* — Mark A Osele
(74) *Attorney, Agent, or Firm* — Griffin & Szipl, P.C.

(57) ABSTRACT

A tape applicator uses a tape feeding device that holds a tape and performs a series of operations of feeding, applying, and cutting the tape with one hand. The tape applicator includes the tape feeding device including a drawing roller rotated together with a tape, a releasing roller feeding the tape in the forward direction while releasing the tape together with rotation of the drawing roller, and a belt coupling the drawing roller and the releasing roller, as well as a tape holding body holding the tape and supporting the tape feeding device, an application unit supported by the tape holding body and that causes the tape to contact with an application target surface, a cutting blade supported by the tape holding body and that cuts the tape, and a case accommodating the tape holding body, wherein the leading end of the tape is reserved in the released state.

5 Claims, 17 Drawing Sheets

(56) References Cited

FOREIGN PATENT DOCUMENTS

| | | |
|---|---|---|
| JP | 10-330021 | 12/1998 |
| JP | 2000-296966 | 10/2000 |
| JP | 2001-130824 | 5/2001 |
| JP | 3092176 U | 2/2003 |

OTHER PUBLICATIONS

Microfilm of the specification and drawings annexed to the request of Japanese Utility Model Application No. 69639/1990 (Laid-open No. 2966/1992) (Onishi Lite Industry Co., Ltd.) Mar. 3, 1992.

Microfilm of the specification and drawings annexed to the request of Japanese Utility Model Application No. 141184/1984 (Laid-open No. 56361/1986) (Hachikazu Takahashi) Apr. 15, 1986.

Microfilm of the specification and drawings annexed to the request of Japanese Utility Model Application No. 49382/1986 (Laid-open No. 161140/1987) (Yugen Kaisha Nitta Moore Company) Oct. 13, 1987.

International Search Report issued in corresponding application PCT/JP2010/071157, completed Jan. 28, 2011 and mailed Feb. 8, 2011.

* cited by examiner (a)

(b)

(a)

(b)

(c)

TAPE FEEDING DEVICE AND TAPE APPLICATOR

This is a Continuation-in-Part of International Patent Application No. PCT/JP2010/071157 filed Nov. 26, 2010, which claims priority on Japanese Patent Application No. 2009-298872, filed Dec. 28, 2009. The entire disclosures of the above patent applications are hereby incorporated by reference.

TECHNICAL FIELD OF THE INVENTION

The present invention relates to a tape applicator that can easily apply an adhesive tape (hereinafter referred to as a "tape" unless otherwise specified) with one hand and relates to a tape feeding device, which is an internal mechanism thereof.

BACKGROUND OF THE INVENTION, INCLUDING ART

A tape wound in a roll shape is difficult to be used by itself, so that the tape is often used together with a so-called "tape holder," which holds the tape in a constantly drawn state to some extent while holding a winding core of the tape. The tape holder is of a handheld type, a desktop type, or an electrically operated type, according to the diameter of the winding core of the tape and application, and is known to have various shapes and configurations (for example, see Patent Documents 1 to 3).

PRIOR ART DOCUMENTS

Patent Documents

Patent Document 1: Japanese Patent Laid-open Publication No. 9-194116

Patent Document 2: Japanese Patent Laid-open Publication No. 2000-296966

Patent Document 3: Japanese Patent Laid-open Publication No. 10-330021

Problems to be Solved by the Invention

However, most tape holders, which are currently widespread, have a very simple configuration in which a tape is drawn by fingers and is cut by means of a cutting blade attached thereto. In such tape holders, a series of operations of drawing, cutting, and applying a tape are required to be performed with both hands. In addition, when the cutting blade is sawtoothed, its cut-line becomes jagged and tape replacement is troublesome.

It would be very convenient if a tape applicator that can easily perform a series of operations of drawing, cutting, and applying a tape with one hand, in one operation, like a so-called "correction tape" for correcting misused characters, can be manufactured inexpensively. However, unlike correction tape, an adhesive tape, which is typically made of a film-like resin, has a high strength. Therefore, after the application, the adhesive tape is required to be cut by means of a cutting blade, or the like, with the result that inexpensive and practical adhesive tapes are hardly known.

To realize such a tape applicator, a special tape feeding mechanism for smoothly and reliably holding a tape and performing a series of operations of feeding, applying, and cutting the tape with one hand is necessary.

The present invention has been made in view of the above and an object of the present invention is to provide a novel tape feeding device and a tape applicator using the same.

SUMMARY OF THE INVENTION

Means for Solving the Problems

A feeding device, according to the present invention, is a tape feeding device for feeding a tape 40 wound around a shaft core in the forward direction, and includes a substantially cylindrical drawing roller 21 rotated together with the tape 40, a releasing roller 23 for feeding the tape 40 in the forward direction while releasing the tape 40 together with the rotation of the drawing roller 21, and a belt 26 which couples the drawing roller 21 and the releasing roller 23.

The feeding device is a main independent component for realizing a tape applicator, according to the present invention, and is attached to part of a tape holding body for use. Further, the "tape" referred to simply in the present invention means a tape wound in a roll shape around the shaft core and any thickness, material, or width thereof can be used. In addition, an adhesive surface is not limited to be provided on a single side and includes a double-sided tape type with a release sheet on the front surface side thereof.

A tape applicator, according to the present invention, includes the tape feeding device, a tape holding body 42 that rotationally holds the tape 40 and supports the tape feeding device, an application unit 3*x*, which is supported by the tape holding body 42 and has an application roller 30 for pressingly contacting the tape 40 onto an application target surface 1*a* and a cutting blade 55, and a case 10 that accommodates the tape holding body 42, wherein the leading end of the tape 40 is reserved in the released state.

To draw the leading end of the tape from the tape 40 wound in a roll shape, a drawing force to some extent is required. In the conventional tape applicator, the tape is projected constantly under the application roller, and even when the application roller is pressed onto the application target surface 1*a* to apply the tape, only part of the tape is applied onto the application target surface 1*a*. Consequently, when a tape applicator 1*h* is pulled in the direction of applying the tape, due to the insufficient application area of the tape, the tape 40 on the application target surface 1*a* slides on the application target surface 1*a* and is torn off when overcome by a force that draws the leading end of the tape from the tape 40 in a roll shape, with the result that the tape cannot be drawn. However, with the tape applicator according to the present invention, a preliminary tape having a sufficient drawing force can be previously applied onto the application target surface 1*a*.

In accordance then, with respect to a first non-limiting illustrative embodiment of the invention, a tape feeding device is provided for feeding a tape (40) wound around a shaft core in a forward direction, which includes: (a) a substantially cylindrical drawing roller (21) rotated together with the tape (40); (b) a releasing roller (23) for feeding the tape (40) in the forward direction while releasing the tape (40) together with the rotation of the drawing roller (21); and (c) a belt (26) which couples the drawing roller (21) and the releasing roller (23). In accordance with a second non-limiting illustrative embodiment of the invention, the first non-limiting illustrative embodiment is modified so that a belt groove (25) for winding the belt (26) on an outer circumference of the drawing roller (21) and/or the releasing roller (23) and a shape of a cross section of the belt groove (25) is a substantially V-shape. In accordance with a third non-limiting illustrative embodiment of the present invention, the first and second non-limiting illustrative embodiments are modified so that the releasing roller (23) has a shape provided with unevenness on a surface thereof.

In accordance with a fourth non-limiting illustrative embodiment of the present invention, a tape applicator is provided that includes: (i) the tape feeding device according to any one of the first, second and third non-limiting illustrative embodiments; (ii) a tape holding body (42) that rotationally holds the tape (40) and supports the tape feeding device; (iii) an application unit (3*x*) that is supported by the tape holding body (42) and has an application roller (30) for pressingly contacting the tape (40) onto an application target surface (1*a*) and a cutting blade (55); and (iv) a case 10 that accommodates the tape holding body (42), wherein a leading end of the tape (40) is reserved in a released state. In accordance with a fifth non-limiting illustrative embodiment of the present invention, the fourth non-limiting illustrative embodiment is modified so that the drawing roller (21) further includes a ratchet wheel (1*b*) rotated in the forward direction together with the drawing roller, the case (10) further includes a driving unit (1*x*) including a driving transmission member (16) having an operating pawl (17) engaged with teeth of the ratchet wheel and a returning spring (14) which biases the driving transmission member to promote the engagement of the ratchet wheel (1*b*) and the operating pawl (17), and the driving transmission member (16) is arranged sidewise in an axial direction of the ratchet wheel (1*b*). In accordance with a sixth non-limiting illustrative embodiment of the present invention, the fifth non-limiting illustrative embodiment is modified so that the cutting blade (55) is arranged so as to be swingably moved between the application roller (30) and the drawing roller (21), and a driving claw (13) for driving the cutting blade (55) is provided in the driving unit (1*x*) so that the cutting blade (55) cuts the tape (40) when the driving unit (1*x*) is returned.

In accordance with a seventh non-limiting illustrative embodiment of the present invention, the fifth or sixth non-limiting illustrative embodiment is further modified so that the driving unit (1*x*) has the driving claw (13), the application unit (3*x*) has a cutting portion (5*x*) for cutting the tape (40), the cutting portion (5*x*) has: a swinging shaft (57) that is swingably supported by the application unit (3*x*), the cutting blade (55) for cutting the tape (40), and arms (33) for holding the cutting blade (55), wherein each arm (33) has an arm claw (50) engaged with the driving claw (13), the cutting blade (55) is arranged so as to be moved between the application roller (30) and the tape feeding device by swinging about the swinging shaft (57), the cutting portion (5*x*) engages the driving claw (13) with the arm claw (50) when the driving unit (1*x*) is returned after driving of the tape feeding device, and a driving force for cutting the tape (40) is obtained by the cutting blade (55). In accordance with a seventh non-limiting illustrative embodiment of the present invention, the seventh non-limiting illustrative embodiment is further modified so that the arm claw (50) has: a plate spring arm (51) that is flexed and biased in a direction of the swinging shaft (57), and a cam (52) that flexes the plate spring arm (51); and the driving claw (13) flexes the plate spring arm (51) and is slid and moved on the cam (52) upon the driving of the tape feeding device, and is engaged with the arm claw (50) after the driving of the tape feeding device. In accordance with a ninth non-limiting illustrative embodiment of the present invention, the seventh or eighth non-limiting illustrative embodiment is further modified so that the arms (33) support the cutting blade (55) by both sides to form a space between the arms (33), and the cutting portion (5*x*) is disposed so as to be capable of passing the tape feeding device through the space and of swinging outside the tape feeding device.

In accordance with a tenth non-limiting illustrative embodiment of the present invention, the seventh, eighth and ninth non-limiting illustrative embodiments are further modified so that the cutting portion (5*x*) further includes: a spring body (5*a*) that performs biasing in a direction of the application roller (30); and a pressing plate (5*b*) that is abutted onto the tape (40) before the cutting blade (55) at an end of the spring body (5*a*), wherein the spring body (5*a*) is disposed rearward of the arms (33) seen from the direction of the application roller (30), and the cutting blade (55) is arranged above the pressing plate (5*b*) by directing a direction of an edge of the cutting blade (55) in the direction of the application roller (30), and the cutting portion (5*x*) is arranged so that the pressing plate (5*b*) is abutted onto an outer circumference of the application roller (30) by swinging about the swinging shaft (57). In accordance with an eleventh non-limiting illustrative embodiment of the present invention, the fourth, fifth, sixth, seventh, eighth, ninth and tenth non-limiting illustrative embodiments are further modified so that the cutting blade (55) is formed in a triangular shape having a center symmetrical axis and projected in a cutting direction of the cutting blade (55) at a center of the edge thereof.

In accordance with a twelfth non-limiting illustrative embodiment of the present invention, the fifth, sixth, seventh, eighth, ninth, tenth and eleventh non-limiting illustrative embodiments are further modified so that the tape applicator further includes an operating spring (45) mutually repelling any one of the application unit (3*x*) and the chassis (4*x*), and the driving unit (1*x*), and biases the driving unit (1*x*) in a direction of an original position. In accordance with a thirteenth non-limiting illustrative embodiment of the present invention, the fourth, fifth, sixth, seventh, eighth, ninth, tenth, eleventh and twelfth non-limiting illustrative embodiments are further modified so that an upper surface of the drawing roller (21) and the releasing roller (23) conveying the tape (40), and an upper surface of the tape holding body (42) that removes a roll of the tape (40), are exposably openable and closable. In accordance with a fourteenth non-limiting illustrative embodiment of the present invention, the fourth, fifth, sixth, seventh, eighth, ninth, tenth, eleventh, twelfth, and thirteenth non-limiting illustrative embodiments are further modified so that a feeding amount of the tape (40) fed from the tape feeding device is a total length of a distance from the leading end of the tape (40) immediately after the tape (40) exits the tape feeding device to a contact point of the application roller (30) and the application target surface (1*a*), and a length of the tape (40) having an adhesive force in which the tape applied onto the application target surface (1*a*) can draw the tape (40) from the tape holding body (42).

Effects of the Invention

In the tape feeding device according to the present invention, the drawing roller is rotated to draw the tape, and the releasing roller following this can always bring the fixed length of the leading end of the tape into the released state. Therefore, when such a tape feeding device is used, the tape applicator, which can feed and reserve the leading end of the tape onto the application target surface and can cut the tape after the application of the tape is completed, can be configured. In particular, the tape can be applied by easy operation with only one hand without fingertips touching the adhesive surface of the tape in a series of operations from the application of the tape to the cutting of the tape.

DETAILED DESCRIPTION OF THE INVENTION

Best Mode for Carrying Out the Invention

First, by way of example, the whole configuration of a tape applicator and its operation will be briefly described. With respect to the drawings, like parts will be labeled using like character references.

Figure 1:
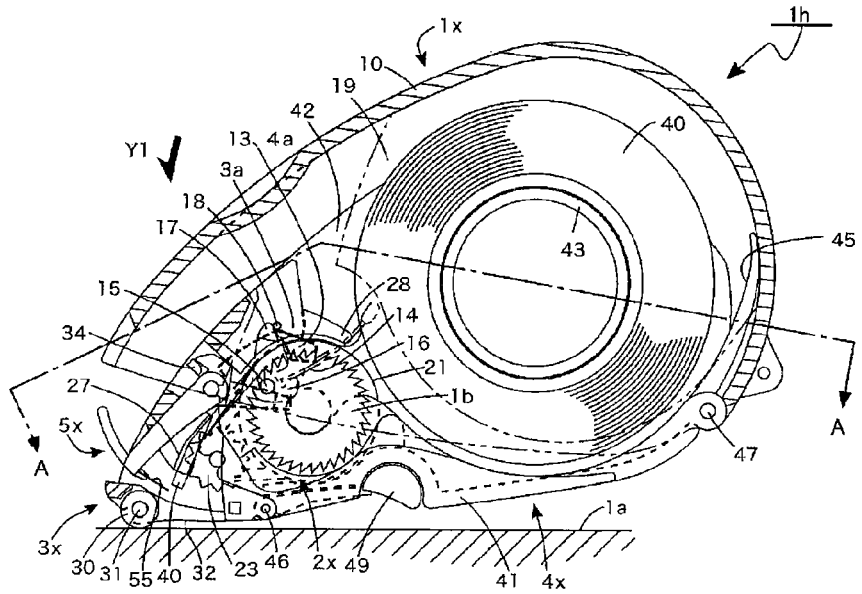
FIG. 1 is an example of a tape applicator, in accordance with the present invention, in which FIG. 1(*a*) is a side view in which part of a case and an application unit is omitted, and FIG. 1(*b*) is a top view of the cross section taken along line A-A of FIG. 1(*a*) seen in the direction indicated by arrows.
Figure 1:
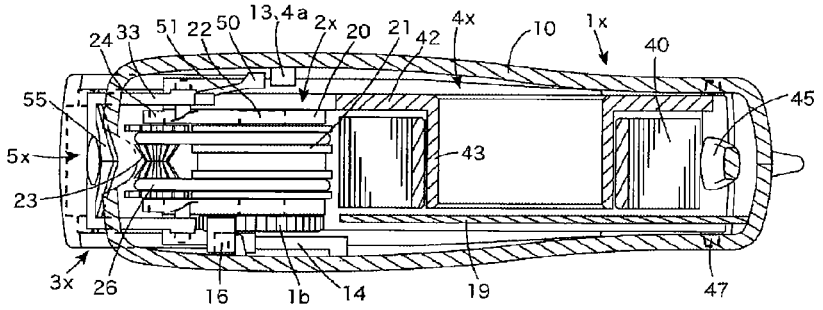

FIG. 1 shows a tape applicator 1*h*. FIG. 1(*a*) is a side view in which part of a case and an application unit is omitted, and FIG. 1(*b*) is a top view of the cross section taken along line A-A of FIG. 1(*a*) seen in the direction indicated by arrows. The tape applicator 1*h* is largely divided into three portions, and includes a chassis 4*x* having a tape 40 in a roll shape and a tape feeding mechanism 2*x*, a case 10 having a driving unit 1*x*, and an application unit 3*x* having an application roller 30 and a cutting portion 5*x*. The detail of each configuration will be described later, but in the tape applicator 1*h*, the case 10 and the chassis 4*x* are biased by an operating spring 45 and are connected. When the case 10 is pressed in the direction indicated by Y1, that is, against the biasing of the operating spring 45, a drawing roller 21 of the tape feeding mechanism 2*x* is rotated to draw the tape 40, thereby feeding the tape 40 in the direction in which the application roller 30 and an application target surface 1*a* on the tape feeding mechanism 2*x* side come into contact. Then, when the pressing indicated by Y1 is removed, the case 10 is returned to its original position, and at the same time, the tape 40 is cut by the cutting portion 5*x*. The configuration and the disposed location of the driving unit 1*x* can be changed, if necessary.

Figure 2:
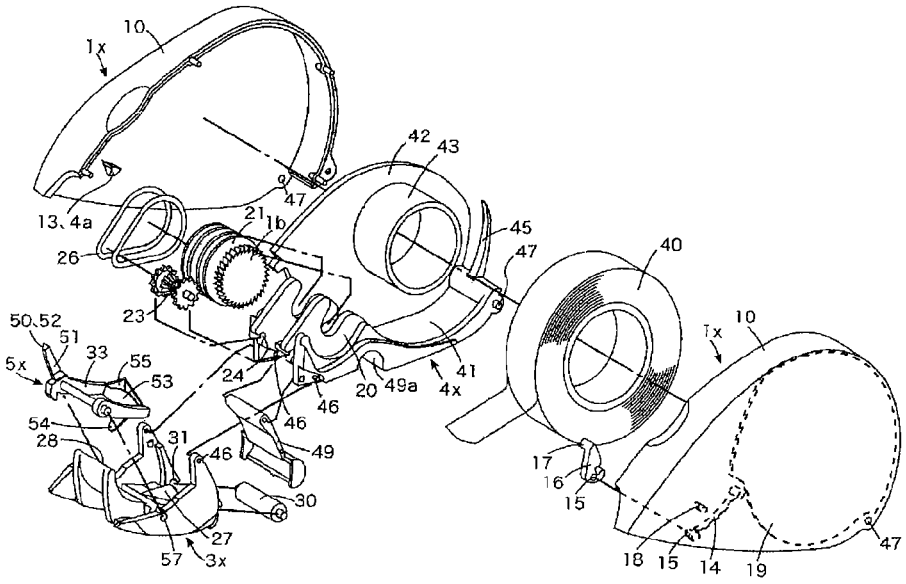
FIG. 2 is an exploded perspective view of the tape applicator of FIG. 1.

FIG. 2 is an exploded perspective view of the tape applicator of FIG. 1. As shown in FIG. 2, the tape applicator 1*h* can be manufactured by easily assembling each member or component.

Figure 3:
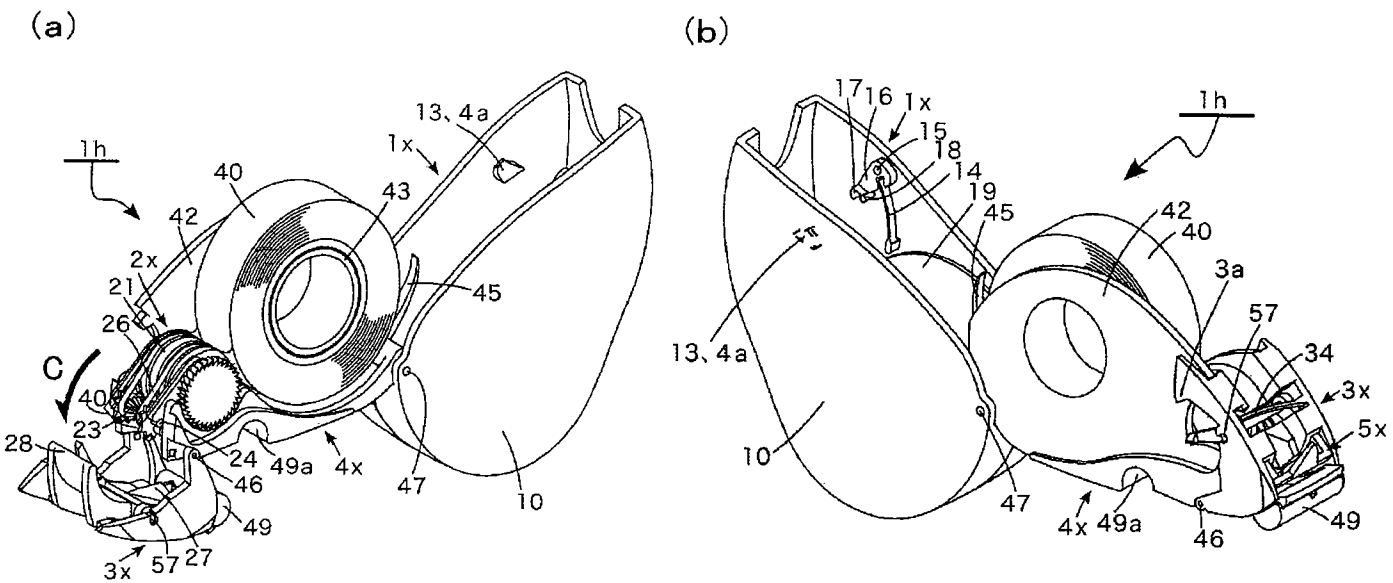
FIG. 3(*a*) is a perspective view in which the tape applicator of FIG. 1 is developed, and FIG. 3(*b*) is another perspective view in which the tape applicator of FIG. 1 is developed.

FIG. 3(*a*) is a perspective view in which the tape applicator of FIG. 1 is explained, and FIG. 3(*b*) is another perspective view in which the tape applicator of FIG. 1 is explained. The tape applicator 1*h* can be opened, first, by rotating the case 10 about a shaft 47 to open the case 10, and then, by rotating the application unit 3*x* in the direction indicated by C, that is, about a shaft 46.

The tape applicator includes the tape feeding mechanism for feeding the tape in the forward direction. Its configuration will be described below in detail.

First Advantageous Embodiment

[Tape Feeding Mechanism]

Figure 4:
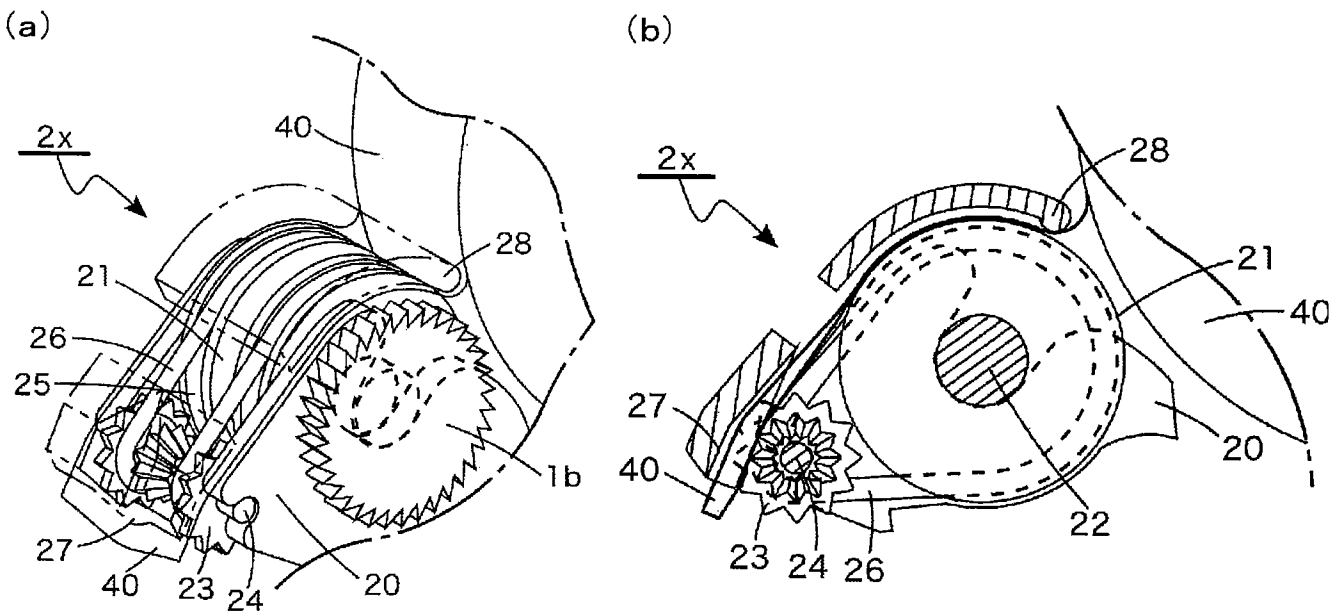
FIG. 4(*a*) is a perspective view showing an example of a tape feeding device, in accordance with the present invention, and FIG. 4(*b*) is a side view of the cross section of the center portion of the tape feeding device of FIG. 4(*a*).

FIG. 4(*a*) is a perspective view for describing the tape feeding mechanism, and FIG. 4(*b*) is a side view of the cross section of the center portion of a tape feeding device of FIG. 4(*a*). The tape feeding mechanism 2*x* includes, as a main component, a tape feeding device including the substantially cylindrical drawing roller 21 rotated together with the tape 40, a releasing roller 23 for feeding the tape 40 in the forward direction while releasing the tape 40 together with the rotation of the drawing roller 21, and a belt 26 which couples the drawing roller 21 and the releasing roller 23. The tape feeding device configures the "tape feeding mechanism" as a whole together with a roller holding portion 20 provided in part of a tape holding body 42, a tension body 28 for securely applying the tape 40 onto around the drawing roller 21, and a propelling member 27 which propels the tape 40 in the fixed direction.

The tension body 28 is arranged above the drawing roller 21 by providing a clearance, which passes the tape 40 therethrough. The propelling member 27 is arranged above the releasing roller 23 along the direction feeding the tape 40 by providing a clearance that passes the tape 40 therethrough. The drawing roller 21 and the releasing roller 23 can be mutually coupled and interlocked by the belt 26, and can be rotated in the same direction.

The drawing roller 21 has a shaft 22, and the releasing roller 23 has a shaft 24. The roller holding portion 20 rotationally holds the drawing roller 21 about the shaft 22, and rotationally holds the releasing roller 23 about the shaft 24, respectively. The drawing roller 21 has, on the outer circumference portion thereof, a surface for adherence of the tape 40. The drawing roller 21 may have a ratchet wheel 1*b*. The ratchet wheel 1*b* has a large number of teeth and is rotated integrally with the drawing roller 21 about the shaft 22. Thereby, the driving force of the driving unit 1*x*, which has been described briefly with reference to FIG. 1, can be transmitted to the drawing roller 21 by a member that is engaged with the teeth of the ratchet wheel 1*b*. Various driving transmission members including the ratchet wheel 1*b*, such as a gear, can be used, and may be provided on the releasing roller 23 side.

The releasing roller 23 preferably has a substantially symmetrical conical shape having a small diameter at the center thereof, a substantially cylindrical shape dented at the center thereof, or a shape provided with an uneven mountain shape on the outer circumference portion thereof. Accordingly, the contact area of the releasing roller 23 and the tape 40 is reduced to easily release the tape 40 from the releasing roller 23. In addition, to easily release the tape 40, which is applied onto the outer circumference portion of the releasing roller 23, the releasing roller 23 may be configured by a member having a silicon layer and a fluorine coating layer on the surface of the outer circumference portion thereof.

The tension body 28 is arranged along the outer circumference portion of the drawing roller 21, and has one end arranged between the drawing roller 21 and the tape 40 in a roll shape. Accordingly, when the tape 40 is drawn, the tape 40 is pressed downward of the drawing roller 21 to reduce the loosening of the tape 40, so that the contact area of the drawing roller 21 and the tape 40 can be increased.

The propelling member 27 has a convex portion at the center thereof along the direction feeding the tape 40. On the other hand, the releasing roller 23 has a concave portion along the whole circumference direction. Part of the shape of the cross section of the convex portion of the propelling member 27 should have a shape that is accommodated in the concave portion of the releasing roller 23. The concave portion of the center portion of the releasing roller 23 and the convex portion of the propelling member 27 are arranged with a fixed clearance. The propelling member 27 can have various shapes such as a triangular prism shape and a semi-cylindrical shape. Accordingly, the tape 40 is curved in the width direction vertical to the feeding direction by the convex portion of the propelling member 27 and is given rigidity with respect to the feeding direction. Therefore, the tape 40 fed from the propelling member 27 can be moved straightly in the hollow even when the tape 40 has a small thickness and is easy to tear. In addition, the arrangement of the propelling member 27 is rotated about the shaft 24 of the releasing roller 23, so that the direction propelling the tape can be changed by the rotation angle.

The belt 26 can be configured by an extendable member, and can have various cross sectional shapes, such as a V-shape and a circular shape. In addition, the belt 26 may be, for example, a timing belt having a large number of gear teeth by providing a timing pulley on the drawing roller 21 and the releasing roller 23. The drawing roller 21 and the releasing roller 23 may have a belt groove 25 for winding the belt 26 on the outer circumference portion thereof.

Figure 5:
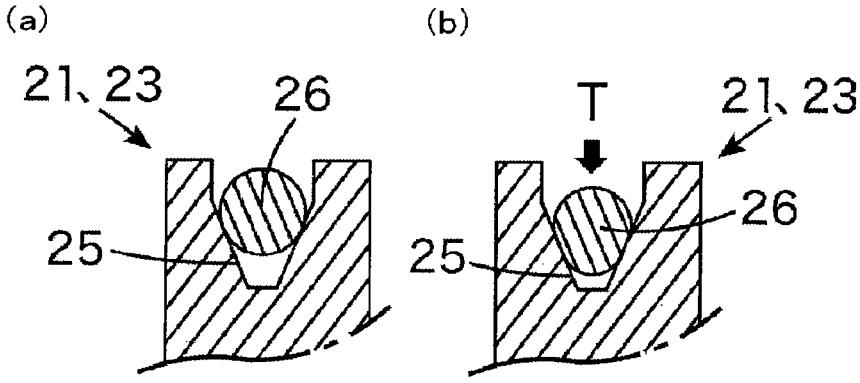
FIG. 5(*a*) is a cross-sectional view of a belt and a belt groove of the tape feeding device of FIG. 4, and FIG. 5(*b*) is a diagram in which a force indicated by an arrow T is applied to the belt of FIG. 5(*a*).

FIG. 5(*a*) is a cross-sectional view of the belt and the belt groove of the tape feeding device of FIG. 4, and FIG. 5(*b*) is a diagram in which a force indicated by an arrow T is applied to the belt of FIG. 5(*a*). As shown in FIG. 5(*a*), the shape of the cross section of the belt groove 25, which is formed on the outer circumference portion of the drawing roller 21 and the releasing roller 23, is a substantially V-shape groove in which the width is smaller toward the center of the rotational shaft of each roller. When the belt 26 is wound around such a belt groove 25 to transmit power to the drawing roller 21 and the releasing roller 23, as shown in FIG. 5(*b*), the force indicated by the arrow T is caused in the belt 26, so that the belt 26 is engaged into the small width portion of the belt groove 25 to increase the friction between the belt groove 25 and the belt 26 in order to prevent mutual sliding, thereby enabling transmission efficiency of the power to be increased.

In the tape feeding mechanism described in the first embodiment, the drawing roller and the releasing roller are rotated, so that the leading end of the tape can be reliably fed from the rotatably supported tape in a roll shape.

Second Advantageous Embodiment

[Tape Applicator Having the Driving Unit in the Case]

Next, the tape applicator embodiment having the driving unit in the case will be described. As the whole configuration has already been shown with reference to FIGS. 1 to 3, the tape applicator 1*h* includes the chassis 4*x* including the tape 40, the tape holding body 42, and the tape feeding device of the first embodiment, as well as the application unit 3*x* for applying the tape 40 onto the application target surface 1*a*, the driving unit 1*x* for drawing and feeding the tape 40, and the case 10, which has the driving unit 1*x* and covers at least part of the application unit 3*x* and the chassis 4*x*. The tape 40 has an adhesive surface on the inside thereof and is rotatably supported in a roll shape by the tape holding body 42, and the application unit 3*x* has the application roller 30, which pressingly applies the tape 40 onto the application target surface 1*a*, wherein the drawing roller 21 has the driving transmission member, and the tape feeding device is arranged so as to draw the tape 40 from the tape holding body 42 for feeding the tape 40 in the direction in which the application roller 30 and the application target surface 1*a* come into contact when a driving force is transmitted to the driving transmission member by the driving unit 1*x* of the case 10.

[Chassis]

In the chassis 4*x*, the tape holding body 42 is disposed so as to be vertical to a bottom plate 41. The tape holding body 42 rotatably holds the tape 40 in a roll shape having the adhesive surface on the inside thereof by a tape holding shaft 43. In addition, the chassis 4*x* includes therein the tape feeding device of the first embodiment. At this time, the roller holding portion 20 may be configured by part of the chassis 4*x*. The rear portion of the chassis 4*x* includes the operating spring 45, which biases the case 10 in the direction of returning the case 10 to its original position. The chassis 4*x* may have an opening or a groove that defines the swinging range of the cutting portion 5*x*. The lower portion of the chassis 4*x* may include a protective cover 49 rotated about the shaft 46. The protective cover 49 covers and protects an opening 32, and the application roller 30 of the application unit, from below when the tape applicator 1*h* is not used, and is accommodated in an accommodating portion 49*a* when the tape applicator 1*h* is used.

[Application Unit]

The application unit 3*x* has a hooking claw 3*a*, which can be engaged with and be disengaged from an opening/closing claw 4*a* of the case 10, and is swingably coupled to the front portion of the chassis 4*x* by the shaft 46. The lower portion of the application unit 3*x* has the application roller 30 rotated about a shaft 31 and the opening 32. The tape 40 is fed from the opening 32 to the outside and is applied by the application roller 30. The application unit 3*x* may have the propelling member 27, which curves the tape of the tape feeding mechanism 2*x* in the width direction so as to propel the tape, or the tension body 28. The application roller 30 is preferably configured by an elastic body such as urethane or rubber. The application unit 3*x* may include the later-described cutting portion 5*x*. When the cutting portion 5*x* is provided in the application unit 3*x*, a returning spring 34, which returns the cutting portion 5*x* to its original position, may be further provided. In addition, the application unit 3*x* may be configured by an integral member with the chassis 4*x*. Alternatively, the application unit 3*x* may be configured by a plurality of members, such as two members on the right and left sides, or may be configured by an integral member. Thus, the opening 32 for feeding the adhesive tape to the outside is formed near the application roller 30, and the tape feeding device 2*x* is driven by the driving unit 1*x*, so that the leading end of the tape can be drawn from the tape wound in a roll shape and held by the tape holding shaft 43, and the leading end of the tape can be fed onto the application target surface on the tape feeding device side from the opening 32 and be reserved thereonto.

[Case]

The case 10 includes a guide 19 that inhibits the shift of the rotation of the tape 40 in a roll shape, the opening/closing claw 4*a* that can be engaged with and be disengaged from the hooking claw 3*a* of the application unit 3*x*, and the driving unit 1*x*, and is swingably coupled to the rear portion of the chassis 4*x* by the shaft 47. The guide 19 may be of any type that inhibits the shift of the rotation of the tape 40. The case 10 and the application unit 3*x* may be configured by two members on the right and left sides or by a plurality of members, or it may be configured by an integral member. In addition, the case 10 may be transparent or semitransparent, and when the case 10 is made of a material, such as a resin, which can visualize the inside thereof, the remaining amount of the tape 40 can be visually determined.

[Operating Spring]

The operating spring 45 mutually repels any one of the application unit 3*x* and the chassis 4*x*, and the driving unit 1*x*, and biases the driving unit 1*x* in the direction of returning the driving unit 1*x* to its original position. The tape applicator 1*h* should obtain such biasing, and the operating spring 45 may be provided in any of the driving unit 1*x*, the application unit 3*x*, and the chassis 4*x*. In addition, the operating spring 45 only needs to be a mutually repelling and biasing member made of metal or resin, and various members, such as a coil spring, can be used other than a plate spring as the operating spring 45.

[Driving Unit]

The driving unit 1*x* includes a driving transmission member 16 including an operating pawl 17 and a driving shaft 15, a stopper 18 that stops the rotation of the driving transmission member 16 about the driving shaft 15, and a returning spring 14, which returns the driving transmission member 16 to its original position. At the time of transmitting a driving force, the driving unit 1*x* engages the operating pawl 17 with the teeth of the ratchet wheel 1*b* of the drawing roller 21 to rotate the ratchet wheel 1*b*. Along with this, the driving transmission member 16 rotates the operating pawl 17 about the driving shaft 15. Then, when the engagement of the operating pawl 17 and the teeth of the ratchet wheel 1*b* is removed after the transmission of the driving force, the driving transmission member 16 is rotated by the driving shaft 15 until the driving transmission member 16 is abutted onto the stopper 18 by the returning spring 14, and is returned to its original position. In addition, the driving unit 1*x* includes a driving claw 13 that is engaged with an arm claw 50 of the cutting portion 5*x*. The driving unit 1*x* is disposed inside the case 10 corresponding to the tape feeding mechanism 2*x* and the cutting portion 5*x*, respectively.

Figure 6:
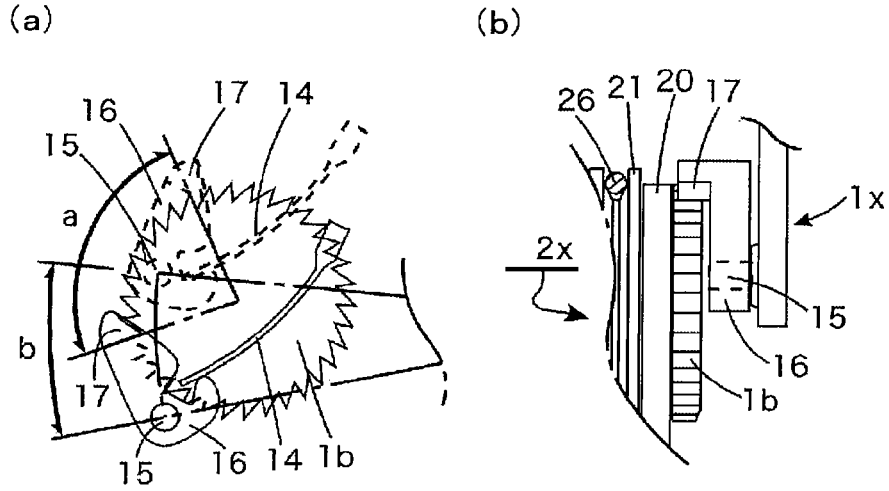
FIG. 6(*a*) is a side view showing an example of the arrangement of a ratchet wheel and a driving transmission member of the tape feeding device of FIG. 4(*a*), and FIG. 6(*b*) is a diagram seen from the front of FIG. 6(*a*).

FIG. 6(*a*) is a side view showing an example of the arrangement of the ratchet wheel and the driving transmission member of the tape feeding device of FIG. 4(*a*), and FIG. 6(*b*) is a diagram seen from the top of FIG. 6(*a*). The driving transmission member 16 of the driving unit 1*x* is additionally provided so as to be swingable by the driving shaft 15, and the driving unit 1*x* and the tape feeding mechanism 2*x* are arranged so that the teeth of the ratchet wheel 1*b* of the tape feeding mechanism 2*x* and the operating pawl 17 of the driving transmission member 16 can be engaged at the time of transmitting a driving force. At this time, as shown in FIG. 6(*a*), when the driving transmission member 16 is rotated by an angle b by the driving unit 1*x*, the operating pawl 17 is engaged with the teeth of the ratchet wheel 1*b* to rotate the ratchet wheel 1*b* by an angle a that is larger than the angle b.

In this way, the driving transmission member 16 is arranged sidewise in the axial direction of the ratchet wheel 1*b*, so that the rotation amount of the ratchet wheel 1*b* is made larger than the rotation amount of the driving transmission member 16, and with this, the feeding amount of the tape 40 can be increased. Therefore, even if the tape feeding mechanism 2*x* is small, a sufficient feeding amount can be obtained.

[Cutting Portion]

Figure 7:
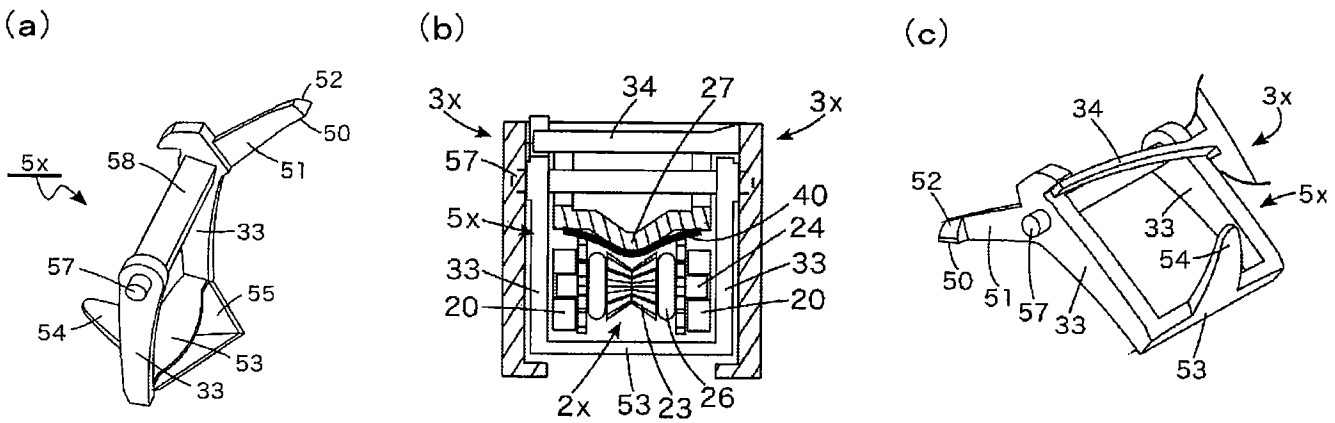
FIG. 7(*a*) is a perspective view showing an example of a cutting portion employed in accordance with the present invention, FIG. 7(*b*) is a partial cross-sectional view showing an example of the arrangement of the cutting portion and the tape feeding device and seen from the front of FIG. 1, and FIG. 7(*c*) is a perspective view showing an example of the arrangement of the cutting portion and a returning spring.

FIG. 7(*a*) is a perspective view showing an example of the cutting portion, FIG. 7(*b*) is a partial cross-sectional view showing an example of the arrangement of the cutting portion and the tape feeding device and seen from the front of FIG. 1, and FIG. 7(*c*) is a perspective view showing an example of the arrangement of the cutting portion and the returning spring, in accordance with embodiments of the present invention. The cutting portion 5*x* includes a swinging shaft 57 that is swingably supported by the application unit 3*x*, a cutting blade 55 for cutting the tape 40, and arms 33 for holding the cutting blade 55. For example, as shown in FIG. 7(*a*), the arms 33 may hold a strut 58 and a cutting blade holding panel 53 that holds the cutting blade 55 by the right and left sides. The cutting blade holding panel 53 may include a cutting button 54 for manually pressing the cutting blade 55. Part of one of the arms 33 has the arm claw 50, which is engaged with the driving claw 13, and an engaging portion that is engaged with the returning spring 34 of the application unit 3*x*.

As shown in FIG. 7(*a*), in order to reduce a force applied to the edge of the cutting blade 55 when the tape 40 is cut, the cutting blade 55 is formed in a triangular shape having a center symmetrical axis and projected in the cutting direction of the cutting blade 55 at the center of the edge of the cutting blade 55. With such a shape, when the tape 40 is cut, the edge of the cutting blade 55 pierces one point at the center of the tape 40, then starts to partially cut the tape 40 from the center thereof to both ends thereof, and gradually cuts the tape 40 with time delay. Therefore, the cutting force applied to the edge of the cutting blade 55 can be reduced. In addition, as compared with when the tape 40 is cut by a sawtoothed cutting blade, a straight cut-line can be obtained. The cutting blade 55, which has the above triangular shape in whole, may have any configuration including one blade or a combination of a plurality of blades. The cutting blade 55 is arranged so as to be moved between the application roller 30 and the tape feeding mechanism 2*x* by the swinging about the swinging shaft 57.

As shown in FIG. 7(*b*), the cutting portion 5*x* supports the cutting blade holding panel 53, which holds the cutting blade 55 and the strut 58 by both sides of the arms 33, to form a space by the cutting blade holding panel 53, the strut 58, and the pair of arms 43. At this time, the length of the interval between the arms 33 is longer than the length of the width of the tape feeding mechanism 2*x*, and the interval between the cutting blade holding panel 53 and the strut 58 is larger than the height of the tape feeding mechanism 2*x*. The cutting portion 5*x* is disposed so as to be capable of passing the tape feeding mechanism 2*x* through the space and of swinging outside the tape feeding mechanism 2*x*. Accordingly, the cutting blade 55 can make the stroke of the swinging sufficient, and even when the tape 40 is slightly loosened, the edge of the cutting blade 55 is abutted onto the tape 40 to provide a tension to the tape 40, thereby enabling the tape 40 to be cut reliably.

After the driving of the tape feeding mechanism 2*x*, that is, after the tape 40 is drawn from the tape holding body 42 and is fed onto the application target surface 1*a*, the cutting portion 5*x* engages the driving claw 13 with the arm claw 50 to drive the cutting blade 55 in order to cut the tape 40. Thereafter, the cutting portion 5*x* is returned to its original position by the returning spring 34. As shown in FIG. 7(*c*), when a driving force is applied from below the arm claw 50 at the time of cutting, the cutting portion 5*x* is rotated by the swinging shaft 57, and the engaging portion of the arms 33 is engaged with the returning spring 34 to press the returning spring 34. Then, when the driving force is removed after cutting, the cutting portion 5*x* is returned to its original position by the returning spring 34.

The arm claw 50 may have a plate spring arm 51, which is flexed and biased in the direction of the swinging shaft 57, and a cam 52 that flexes the plate spring arm 51. When the arm claw 50 is configured in this manner, a driving force can be transmitted to the cutting portion 5*x* by the driving unit 1*x* after the driving of the tape feeding mechanism 2*x*. As a mechanism in which the driving unit 1*x* transmits the driving force to the cutting portion 5*x*, the relation between the driving claw 13 of the driving unit 1*x* and the plate spring arm 51 of the cutting portion 5*x* will be described below.

Figure 8:
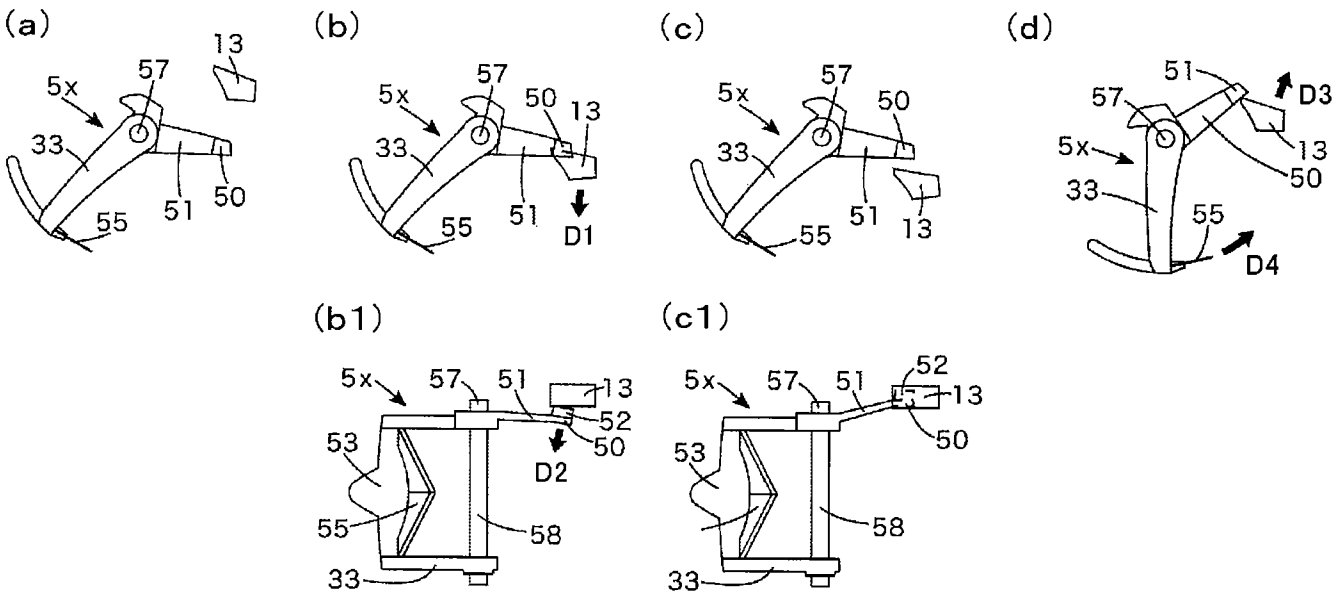
FIG. 8 is a diagram showing an example of the position change of a plate spring arm of the cutting portion, in which FIG. 8(*a*) is a side view before a driving claw passes through the plate spring arm, FIG. 8(*b*) is a side view while the driving claw passes through the plate spring arm, FIG. 8(*b*1) is a diagram seen from the top of FIG. 8(*b*), FIG. 8(*c*) is a side view after the driving claw passes through the plate spring arm, FIG. 8(*c*1) is a diagram seen from the top of FIG. 8(*c*), and FIG. 8(*d*) is a side view when the driving claw is returned.

FIG. 8 is a diagram showing an example of the position change of the plate spring arm of the cutting portion, in which FIG. 8(*a*) is a side view before the driving claw passes through the plate spring arm, FIG. 8(*b*) is a side view while the driving claw passes through the plate spring arm, FIG. 8(*bl*) is a diagram seen from the top of FIG. 8(*b*), FIG. 8(*c*) is a side view after the driving claw passes through the plate spring arm, FIG. 8(*c*1) is a diagram seen from the top of FIG. 8(*c*), and FIG. 8(*d*) is a side view when the driving claw is returned.

The driving unit 1*x* disposed in the case 10 has the driving claw 13, and the driving claw 13 is arranged above the end of the arm claw 50, as shown in FIG. 8(*a*), before driving, that is, before the case 10 is pressed from above. At this time, the cam 52 is located on the opposite side of the end of the arm claw 50 and is arranged so that when the case 10 is pressed to move the driving claw 13 downward, the inclined portion of the cam 52 and part of the driving claw 13 come into contact. The inclined portion of the cam 52 may be provided to the driving claw 13. When the case 10 is pressed from above, as shown in FIGS. 8(*b*) and 8(*bl*), the driving claw 13 is moved in the direction indicated by an arrow D1, and when the inclined portion of the cam 52 and part of the driving claw 13 come into contact, the driving claw 13 is slid and moved on the inclined portion of the cam 52 while flexing the plate spring arm 51 in the direction indicated by an arrow D2. When the driving claw 13 is moved in the direction of the arrow D1, the tape feeding mechanism 2*x* is driven by the driving unit 1*x* and draws the tape 40 from the tape holding body 42 to feed the tape 40 onto the application target surface 1*a*. Thereafter, as shown in FIGS. 8(*c*) and 8(c1), the driving claw 13 is passed over the plate spring arm 51 and is moved below the plate spring arm 51. At this time, the plate spring arm 51 is returned into the state before the plate spring arm 51 comes into contact with the driving claw 13. Thereafter, when the pressing of the case 10 is removed, as shown in FIG. 8(*d*), the driving claw 13 is moved in the direction indicated by an arrow D3 while being engaged with the arm claw 50 by the operating spring 45. At this time, since the cutting portion 5*x* is rotated about the swinging shaft 57, the cutting blade 55 is moved in the direction indicated by an arrow D4 to cut the tape.

[Explanation of the Tape Applicator Having the Driving Unit in the Case]

Figure 9:
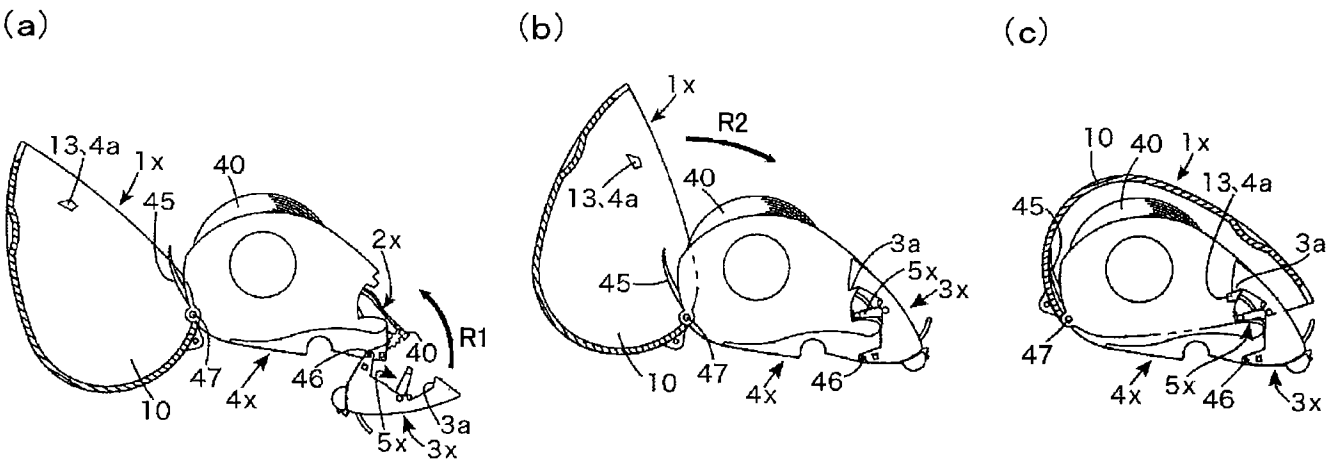
FIG. 9 is an explanatory view of the tape applicator of FIG. 1, in which FIG. 9(*a*) is a side view in which the application unit and the partially omitted case are opened, FIG. 9(*b*) is a side view in which the application unit of FIG. 9(*a*) is partially closed, and FIG. 9(*c*) is a side view in which the case of FIG. 9(*b*) is closed.

FIG. 9 is an explanatory view of the tape applicator of FIG. 1, in which FIG. 9(*a*) is a side view in which the application unit and the partially omitted case are opened, FIG. 9(*b*) is a side view in which the application unit of FIG. 9(*a*) is closed, and FIG. 9(*c*) is a side view in which the case of FIG. 9(*b*) is partially closed. As shown in FIG. 9(*a*), operation of the tape applicator 1*h* can be explained by rotating the case 10 rearward and the application unit 3*x* forward, with the chassis 4*x* as the center. In such a developed state, the tape 40 in a roll shape is attached to the tape holding body 42 to draw the leading end of the tape 40 to apply it onto the outer circumference portion of the drawing roller 21 and the releasing roller 23. Thereafter, after the application unit 3*x* is rotated about the shaft 46 in the direction indicated by an arrow R1 and is closed, as shown in FIG. 9(*b*), the case 10 is rotated about the shaft 47 in the direction indicated by an arrow R2 and is closed. Then, as shown in FIG. 9(*c*), the hooking claw 3*a* of the application unit 3*x* is engaged with the opening/closing claw 4*a* of the case 10. Furthermore, the case 10 is biased in the direction of opening the case 10 by the repellent force of the operating spring 45 of the chassis 4*x*. Therefore, the opening/closing claw 4*a* and the hooking claw 3*a* preferably have a shape that cannot be disengaged even when the case 10 is pulled in the direction of opening the case 10. Accordingly, the operation of the tape applicator 1*h* can be carried out easily, and the replacement of the tape 40 and the initial setting of the tape 40 can be carried out easily and immediately.

Figure 10:
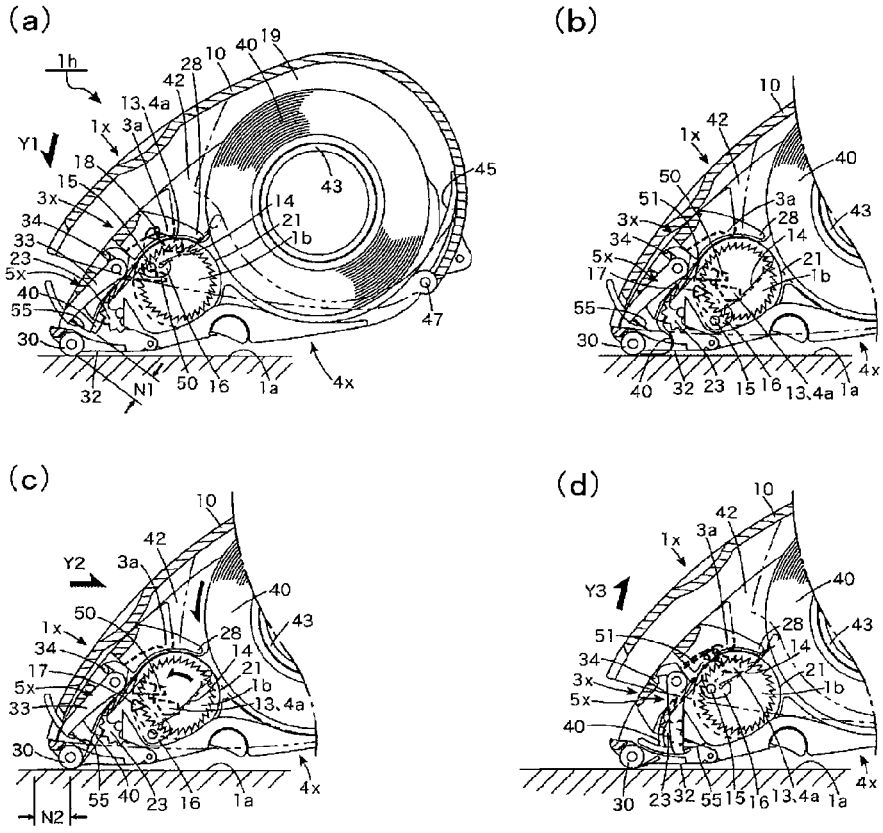
FIG. 10 is a diagram showing an example of the operated state of the tape applicator of FIG. 1, in which FIG. 10(*a*) is a side view showing the whole tape applicator in which part of the case and the application unit is omitted, FIG. 10(*b*) is a side view showing part of the tape applicator after the feeding of the tape in FIG. 10(*a*), FIG. 10(*c*) is a side view showing part of the tape applicator at the time of applying the tape in FIG. 10(*a*), and FIG. 10(*d*) is a side view showing part of the tape applicator after the cutting of the tape in FIG. 10(*a*).

FIG. 10 is a diagram showing an example of the operated state of the tape applicator of FIG. 1, in which FIG. 10(*a*) is a side view showing the whole tape applicator in which part of the case and the application unit is omitted, FIG. 10(*b*) is a side view showing part of the tape applicator after the feeding of the tape in FIG. 10(*a*), FIG. 10(*c*) is a side view showing part of the tape applicator at the time of applying the tape in FIG. 10(*a*), and FIG. 10(*d*) is a side view showing part of the tape applicator after the cutting of the tape in FIG. 10(*a*).

First, a user holds the case 10 to press the application roller 30 onto the application target surface 1*a*. Then, as shown in FIG. 10(*a*), the case 10 is pressed in the direction indicated by the arrow Y1 against the biasing of the operating spring 45. At this time, the operating pawl 17 of the driving transmission member 16 disposed on the inner side surface of the case 10 is engaged with the teeth of the ratchet wheel 1*b* of the tape feeding mechanism 2*x* to rotate the ratchet wheel 1*b* in the forward direction (in the counterclockwise direction in FIG. 10). The drawing roller 21 is rotated integrally with the ratchet wheel 1*b* to draw the tape 40 in a roll shape from the tape holding body 42, places the tape 40 on the outer circumference portion of the drawing roller 21, and conveys the tape 40 to the releasing roller 23. The belt 26 transmits power to the releasing roller 23, and releases the tape 40 from the drawing roller 21 to convey the tape 40 to the outer circumference portion of the releasing roller 23. The releasing roller 23 feeds the tape 40 onto the application target surface 1*a* behind the tape feeding mechanism 2*x* side of the application roller 30 while making the tape 40 curve in the width direction by the convex portion of the propelling member 27. Then, as shown in FIG. 10(*b*), the leading end of the tape 40 is pressed onto the portion in which the application roller 30 and the application target surface 1*a* come into contact. The tape 40, which loses a place to go, is flexed and reserved so that the adhesive surface makes contact with the application target surface 1*a*. At this time, the driving claw 13 disposed on the inner side surface of the case 10 is slid on and is passed over the arm claw 50 of the cutting portion 5*x*, and is moved downward of the arm claw 50.

The feeding amount of the tape 40 is, at this time, preferably the total length of a distance N1 from the leading end of the tape 40 immediately after the tape 40 exits the tape feeding mechanism 2*x* to the portion in which the application roller 30 and the application target surface 1*a* come into contact, and a length N2 of the tape 40 having a sufficient adhesive force for drawing the tape 40 from the tape holding body 42.

Thereafter, as shown in FIG. 10(*c*), the whole tape applicator 1*h* in the state of pressing the case 10 is pulled in the direction indicated by an arrow Y2. At this time, first, the reserved tape 40 is pressed by the application roller 30 from above, and is applied onto the application target surface 1*a* by the length N2 or more. Then, the whole tape applicator 1*h* is pulled in the direction indicated by the arrow Y2 in the state of pressing the case 10, and the reserved tape is applied onto the application target surface 1*a* to change the subsequent tape 40 from the flexed state of FIG. 10(*b*) to the tensioned state of FIG. 10(*c*). Thereafter, the tape 40 is applied onto the application target surface 1*a* while being drawn by the adhesive force of the tape 40 applied onto the application target surface 1*a*. When the tape 40 applied onto the application target surface 1*a* is less than the length N2, the application of the tape fails, but the pressing of the case 10 may be removed once to press the case 10 again for additionally drawing the tape. When the tape is drawn by the desired length, the application is ended.

Thereafter, the pressing of the case 10 is removed. At this time, as shown in FIG. 10(*d*), the case 10 is swung in the direction indicated by an arrow Y3 by the operating spring 45, and the driving claw 13 disposed on the inner side surface of the case 10 is engaged with the arm claw 50 of the cutting portion 5*x* from below to lift the arm claw 50 upward against the biasing of the returning spring 34. Then, the cutting portion 5*x* is rotated in the counterclockwise direction about the swinging shaft 57, and the cutting blade 55 is abutted onto the tape 40 between the application roller 30 and the releasing roller 23 from the direction vertical to the moving direction of the tape 40 to cut the tape 40. If the cutting of the tape 40 fails, then the tape 40 can also be cut by pressing the cutting button 54 of the cutting portion 5*x* by hand to rotate the cutting portion 5*x* about the swinging shaft 57.

After the cutting of the tape 40, the driving claw 13 is moved in the direction of the terminal end of the arm claw 50, and when the engagement of the driving claw 13 and the arm claw 50 is removed, the cutting portion 5*x* is returned to its original position by the biasing of the returning spring 34. The driving claw 13 is abutted onto the hooking claw 3*a* of the application unit 3*x* by the biasing of the operating spring 45 and is returned to its original position. The operating pawl 17 of the driving transmission member 16 is returned to its original position while being slid on the teeth of the ratchet wheel 1*b* by the returning spring 14. Since the subsequent tape 40 that has been cut is left on the outer circumference portion of the drawing roller 21 and the releasing roller 23, the drawing and feeding of the next tape 40 can be carried out reliably.

In the tape applicator of the second embodiment, when the case is pressed from above, the leading end of the tape is fed and reserved onto the application target surface 1*a*, and when the pressing of the case is removed after the application of the tape is completed, the tape can be cut. Other than when the tape in a roll shape is first attached, the tape cannot be touched, thereby enabling clean tape application. In addition, the respective processes of drawing, feeding, applying, and cutting the tape are performed immediately and reliably, so that the tape application operation can be carried out repeatedly and continuously. In addition, since the tape applicator of the second embodiment has a simple configuration, the tape applicator can be small, and can be manufactured at low cost.

Third Advantageous Embodiment

[Tape Applicator Having the Driving Unit in the Pressing Button]

Next, the tape applicator embodiment having the driving unit in the pressing button will be described below. The tape applicator having the driving unit in the pressing button changes part of the configuration of the applicator of the second embodiment. Furthermore, portions shared with the applicator of the second embodiment are indicated by the same reference numerals and the description thereof is omitted.

Figure 11:
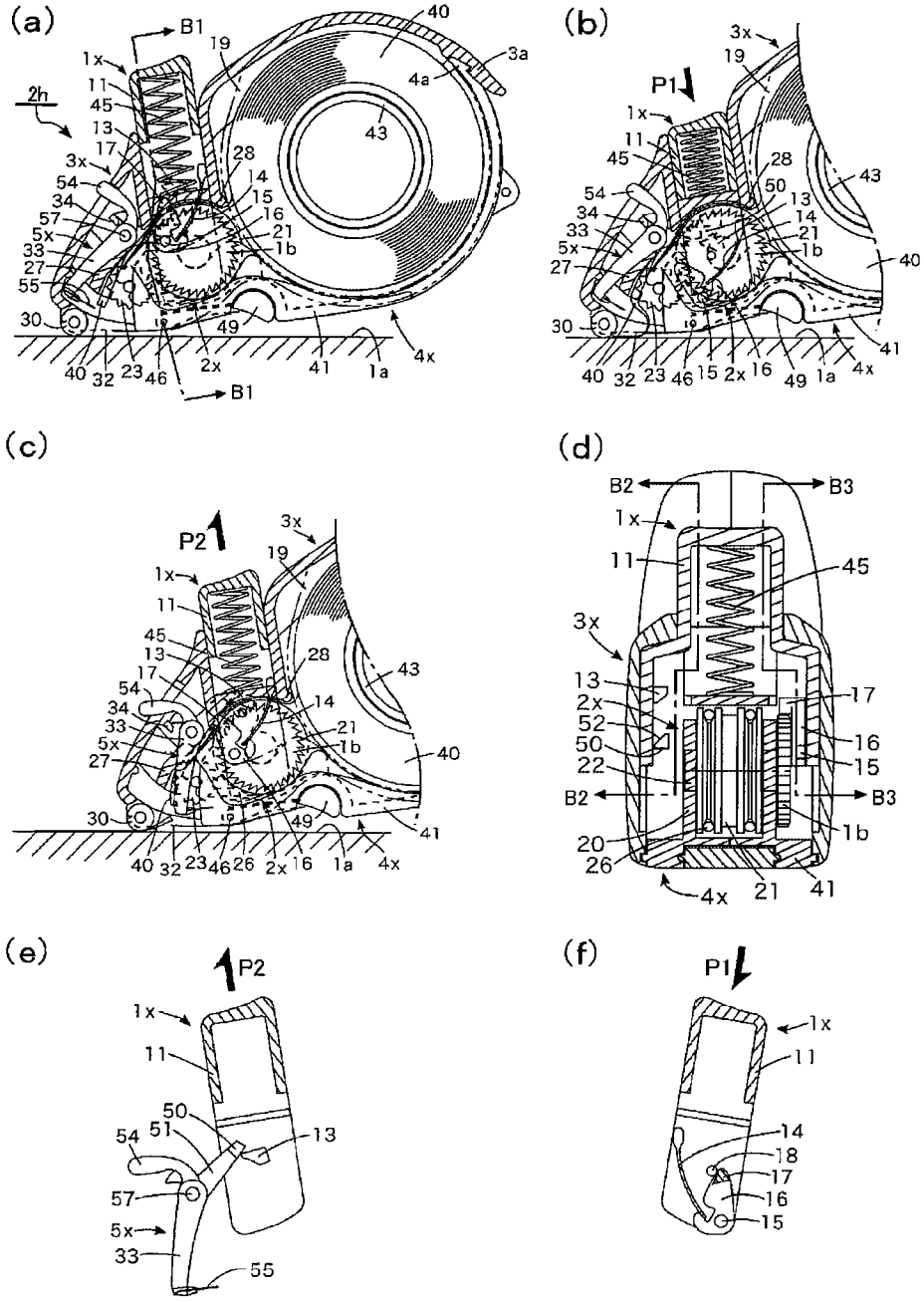
FIG. 11 is a diagram showing another example of the tape applicator, in accordance with the present invention, in which FIG. 11(*a*) is a side view showing the whole tape applicator in which part of the application unit, a chassis, and a pressing button is omitted, FIG. 11(*b*) is a side view showing part of the tape applicator after the feeding of the tape in FIG. 11(*a*), FIG. 11(*c*) is a side view showing part of the tape applicator after the cutting of the tape in FIG. 11(*a*), FIG. 11(*d*) is a cross-sectional view of the cross section taken along line B1-B1 of FIG. 11(*a*) seen in the direction indicated by arrows, FIG. 11(*e*) is a diagram of the cross section taken along line B2-B2 of FIG. 11(*d*) seen in the direction indicated by arrows and is a diagram showing the relation between one side of a driving unit and the cutting portion, and FIG. 11(*f*) is a diagram of the cross section taken along line B3-B3 of FIG. 11(*d*) seen in the direction indicated by arrows and is a diagram showing the other side of the driving unit.

FIG. 11 is a diagram showing another example of the tape applicator, in which FIG. 11(*a*) is a side view showing the whole tape applicator in which part of the application unit, the chassis, and a pressing button is omitted, FIG. 11(*b*) is a side view showing part of the tape applicator after the feeding of the tape in FIG. 11(*a*), FIG. 11(*c*) is a side view showing part of the tape applicator after the cutting of the tape in FIG. 11(*a*), FIG. 11(*d*) is a cross-sectional view of the cross section taken along line B1-B1 of FIG. 11(*a*) seen in the direction indicated by arrows, FIG. 11(*e*) is a diagram of the cross section taken along line B2-B2 of FIG. 11(*d*) seen in the direction indicated by arrows and is a diagram showing the relation between one side of the driving unit and the cutting portion, and FIG. 11(*f*) is a diagram of the cross section taken along line B3-B3 of FIG. 11(*d*) seen in the direction indicated by arrows and is a diagram showing the other side of the driving unit.

Since a tape applicator 2*h* does not have the case 10 of the tape applicator of the second embodiment, the function of the case 10 is shared between the application unit 3*x* and the chassis 4*x*. Therefore, the tape applicator 2*h* largely has the application unit 3*x* and the chassis 4*x*, where the application unit 3*x* additionally includes a pressing button 11 having the driving unit 1*x*, and which is movable up and down by the operating spring 45, and the guide 19 that inhibits the shift of the rotation of the tape 40 in a roll shape, and the chassis 4*x* (from which the operating spring 45 is removed) additionally includes the opening/closing claw 4*a*, which can be engaged with and be disengaged from the hooking claw 3*a* of the application unit 3*x*. Other components mainly have the same configurations as in the tape applicator of the second embodiment other than the change of the forms of the respective portions.

As shown in FIG. 11(*d*), the pressing button 11 includes an upper portion and a lower portion, with a step in the width direction, and the upper portion is projected from above the application unit 3*x* and is arranged above the tape feeding mechanism 2*x*. The pressing button 11 uses the application unit 3*x*, onto which the step is abutted, as the stopper in the upper direction, and the lower portion is movable up and down on both sides of the tape feeding mechanism 2*x*. As shown in FIGS. 11(*e*) and 11(*f*), like in the second embodiment, as the driving unit 1*x*, one inner side of the lower portion of the pressing button 11 includes the driving claw 13 that is engaged with the arm claw 50 of the cutting portion 5*x* from below, as indicated by an arrow P2, and the other inner side thereof includes the driving transmission member 16 having the operating pawl 17, which is engaged with the teeth of the ratchet wheel 1*b* of the tape feeding mechanism 2*x* from above, as indicated by an arrow P1. The operating spring 45 is disposed inside the pressing button 11 so as to be abutted onto the stopper therebelow. The stopper therebelow may serve as the tension body 28.

Since the tape applicator 2*h* basically performs the same operation as the tape applicator of the second embodiment, the application of the tape can be carried out by the same procedure. The procedure of applying the tape will be briefly described below. As shown in FIG. 11(*a*), first, the user presses the application roller 30 of the tape applicator 2*h* onto the application target surface 1*a*. Next, as shown in FIG. 11(*b*), when the pressing button 11 is pressed in the direction indicated by the arrow P1, like the tape applicator of the second embodiment, the operating pawl 17 disposed to the driving transmission member 16 drives the tape feeding mechanism 2*x* and the leading end of the tape 40 is pressed onto the portion in which the application roller 30 and the application target surface 1*a* on the tape feeding mechanism 2*x* side come into contact. The tape 40, which loses a place to go, is flexed and reserved so that the adhesive surface makes contact with the application target surface 1*a*. Thereafter, in the state wherein the pressing button 11 is pressed, the whole tape applicator 2*h* is pulled in the desired direction to apply the tape 40. Thereafter, as shown in FIG. 11(*c*), the pressing of the pressing button 11 is removed to move the pressing button 11 in the direction indicated by the arrow P2. At this time, as shown in FIG. 11(*e*), the driving claw 13 disposed on one inner side surface of the pressing button 11 is engaged with the arm claw 50 of the cutting portion 5*x* from below to lift the arm claw 50 upward against the biasing of the returning spring 34. Then, the cutting portion 5*x* is rotated in the counterclockwise direction about the swinging shaft 57, and the cutting blade 55 is abutted onto the tape 40 between the application roller 30 and the releasing roller 23 from the direction vertical to the moving direction of the tape 40 to cut the tape 40. When the cutting of the tape 40 fails, the cutting button 54 of the cutting portion 5*x* is pressed by hand to rotate the cutting portion 5*x* about the swinging shaft 57 for cutting the tape 40.

The driving claw 13 is moved in the direction of the terminal end of the arm claw 50 after the cutting of the tape 40, and when the engagement of the driving claw 13 and the arm claw 50 is removed, the cutting portion 5*x* is returned to its original position by the biasing of the returning spring 34. The driving claw 13 is abutted onto the hooking claw 3*a* of the application unit 3*x* by the biasing of the operating spring 45, and is returned to its original position. The operating pawl 17 of the driving transmission member 16 is returned to its original position while being slid on the teeth of the ratchet wheel 1*b* by the returning spring 14. Since the subsequent tape 40 that has been cut is left on the outer circumference portion of the drawing roller 21 and the releasing roller 23, the drawing and feeding of the next tape 40 can be carried out reliably.

[Explanation of the Tape Applicator Having the Driving Unit in the Pressing Button]

Figure 12:
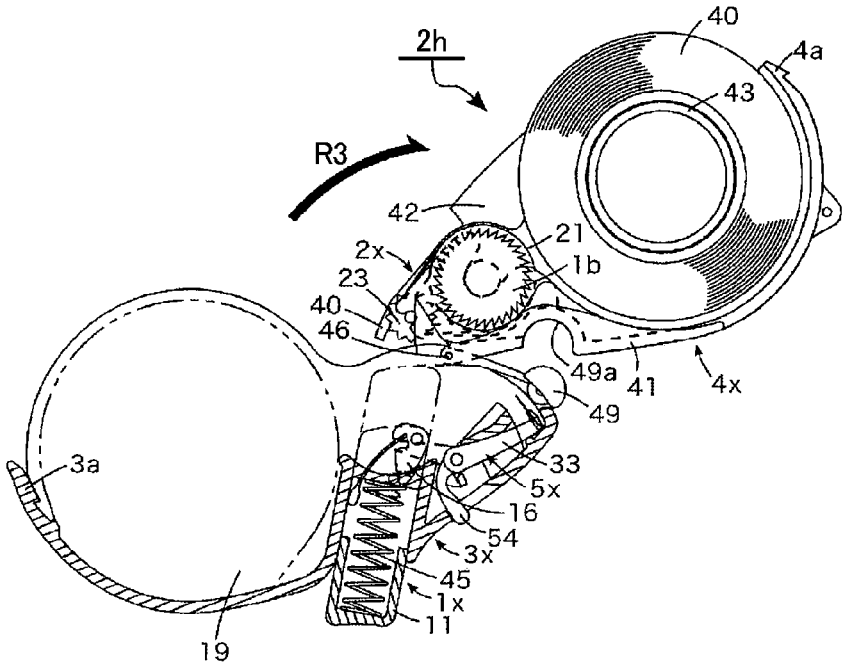
FIG. 12 is a developed view of the tape applicator of FIG. 11 and is a side view showing the whole tape applicator in which part of the application unit and the pressing button is omitted.

FIG. 12 is an explanatory view of the tape applicator of FIG. 11, and is a side view showing the whole tape applicator in which part of the application unit and the pressing button is omitted. As shown in FIG. 12, the tape applicator 2*h* can be operated by rotating the application unit 3*x* forward of the chassis 4*x*. In such a developed state, the tape 40 in a roll shape is attached to the tape holding body 42, and the leading end of the tape 40 is drawn and is applied onto the outer circumference portion of the drawing roller 21 and the releasing roller 23. Thereafter, the application unit 3*x* is rotated about the shaft 46 in the direction indicated by an arrow R3 and is closed, and then, the hooking claw 3*a* of the application unit 3*x* is engaged with the opening/closing claw 4*a* of the chassis 4*x*. With such a configuration, the operation of the tape applicator 2*h* can be carried out easily, and the replacement of the tape 40 and the initial setting of the tape 40 can be carried out easily and immediately.

In the tape applicator in accordance with the third embodiment of the present invention, when the pressing button is pressed from above, the leading end of the tape is fed and reserved onto the application target surface 1*a*, and when the pressing of the pressing button is removed after the application of the tape is completed, the tape can be cut. Accordingly, the same effect as the second embodiment can be expected.

Fourth Advantageous Embodiment

[Tape Applicator Having the Driving Unit in a Lever]

Next, the tape applicator embodiment having the driving unit in a lever will be described below. The tape applicator having the driving unit in the lever simply changes part of the configuration of the applicator of the second embodiment. Furthermore, portions shared with the applicator of the second embodiment are indicated by the same reference numerals and the description thereof is omitted.

Figure 13:
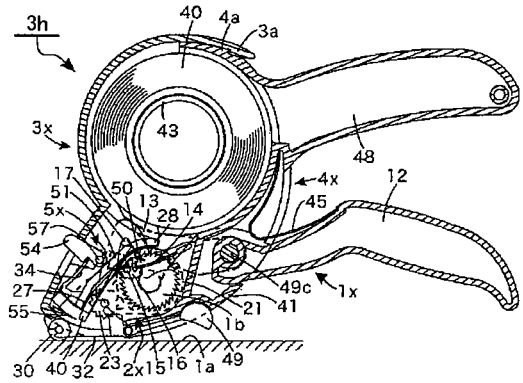
FIG. 13 is a diagram showing another example of the tape applicator, in accordance with the present invention, in which FIG. 13(*a*) is a side view showing the whole tape applicator in which part of the application unit, the chassis, and a lever is omitted, FIG. 13(*b*) is a side view showing part of the tape applicator after the feeding of the tape in FIG. 13(*a*), and FIG. 13(*c*) is a side view showing part of the tape applicator after the cutting of the tape in FIG. 13(*a*).
Figure 13:
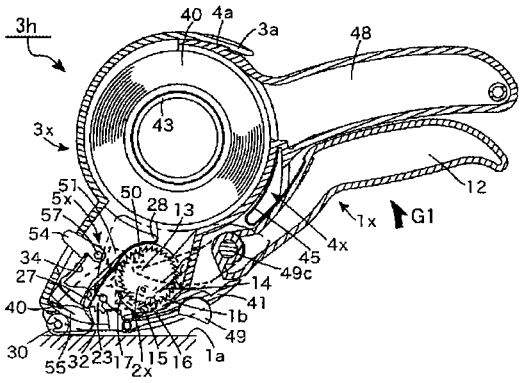
Figure 13:
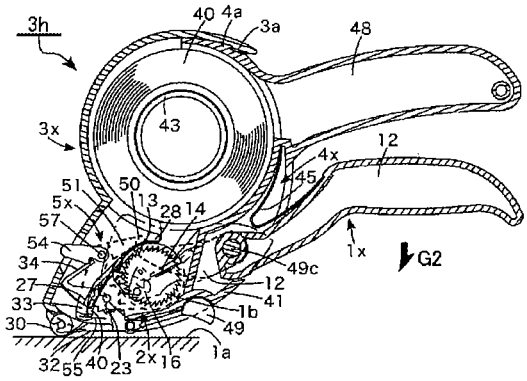
Figure 14:
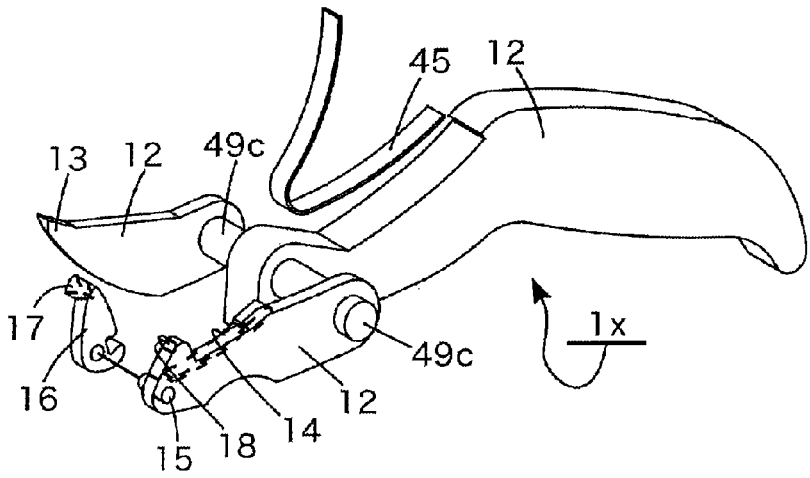
FIG. 14 is a perspective view of the lever of the tape applicator of FIG. 13.

FIG. 13 is a diagram showing another example of the tape applicator, in which FIG. 13(*a*) is a side view showing the whole tape applicator in which part of the application unit, the chassis, and the lever is omitted, FIG. 13(*b*) is a side view showing part of the tape applicator after the feeding of the tape in FIG. 13(*a*), and FIG. 13(*c*) is a side view showing part of the tape applicator after the cutting of the tape in FIG. 13(*a*). FIG. 14 is a perspective view of the lever of the tape applicator of FIG. 13.

Since a tape applicator 3*h* does not have the case 10 of the tape applicator of the second embodiment, the function of the case 10 is shared between the application unit 3*x* and the chassis 4*x*. Therefore, the tape applicator 3*h* largely has the application unit 3*x* and the chassis 4*x*, where the application unit 3*x* additionally includes the guide 19 that inhibits the shift of the rotation of the tape 40 in a roll shape, and the chassis 4*x* additionally includes a lever 12 having the driving unit 1*x* and that is openable and closable by the operating spring 45, a handle 48 used for opening and closing the lever 12, and the opening/closing claw 4*a* that can be engaged with and be disengaged from the hooking claw 3*a* of the application unit 3*x*. Other components mainly have the same configuration as the tape applicator of the second embodiment other than the change of the forms of the respective portions described above.

As shown in FIG. 14, the lever 12 leaves the portions rotatably held by the chassis 4*x* at both ends of a shaft 49*c*, and similarly to the second embodiment, as the driving unit 1*x*, one side of the lever 12 includes the driving claw 13, which is engaged with the arm claw 50 of the cutting portion 5*x* from below, as indicated by an arrow G1, and the other side thereof includes the driving transmission member 16 having the operating pawl 17 that is engaged with the teeth of the ratchet wheel 1*b* of the tape feeding mechanism 2*x* from above, as indicated by an arrow G2. The lever 12 is disposed below the handle 48. The operating spring 45 is provided between the lever 12 and the handle 48, and biases the lever 12 so that the lever 12 is rotated by the shaft 49*c* in the opposite direction of the handle 48.

Since the tape applicator 3*h* basically performs the same operation as the tape applicator of the second embodiment, the application of the tape can be carried out by the same procedure. Thus, the procedure of applying the tape will be briefly described below. As shown in FIG. 13(*a*), first, the application roller 30 of the tape applicator 3*h* is pressed onto the application target surface 1*a*. Next, as shown in FIG. 13(*b*), when the lever 12 is closed in the direction indicated by the arrow G1, similarly to the tape applicator of the second embodiment, the operating pawl 17 disposed to the driving transmission member 16 drives the tape feeding mechanism 2*x* and the leading end of the tape 40 is pressed onto the portion in which the application roller 30 and the application target surface 1*a* on the tape feeding mechanism 2*x* side come into contact. The tape 40, which loses a place to go, is flexed and reserved so that the adhesive surface makes contact with the application target surface 1*a*. Thereafter, in the state that the lever 12 is closed, the whole tape applicator 3*h* is pulled in the desired direction to apply the tape 40. Thereafter, as shown in FIG. 13(*c*), the force of the lever 12 is removed to move the lever 12 in the direction indicated by the arrow G2. At this time, the driving claw 13 of the lever 12 is engaged with the arm claw 50 of the cutting portion 5*x* from below to lift the arm claw 50 upward against the biasing of the returning spring 34. Then, the cutting portion 5*x* is rotated in the counterclockwise direction about the swinging shaft 57, and the cutting blade 55 is abutted onto the tape 40 between the application roller 30 and the releasing roller 23 from the direction vertical to the moving direction of the tape 40 to cut the tape 40. When the cutting of the tape 40 fails, the cutting button 54 of the cutting portion 5*x* is pressed by hand to rotate the cutting portion 5*x* about the swinging shaft 57 for cutting the tape 40. The tape applicator 3*h* is configured in this manner, so that the pressing force of the application roller 30 onto the application target surface 1*a* can be applied freely, and even when the tape applicator 3*h* is temporarily released from the top of the application target surface 1*a* in the state that the lever 12 is pulled, the tape 40 cannot be cut.

The driving claw 13 is moved in the direction of the terminal end of the arm claw 50 after the cutting of the tape 40, and when the engagement of the driving claw 13 and the arm claw 50 is removed, the cutting portion 5*x* is returned to its original position by the biasing of the returning spring 34. The driving claw 13 is abutted onto the hooking claw 3*a* of the application unit 3*x* by the biasing of the operating spring 45, and is returned to its original position. The operating pawl 17 of the driving transmission member 16 is returned to its original position while being slid on the teeth of the ratchet wheel 1*b* by the returning spring 14. Since the subsequent tape 40 that has been cut is left on the outer circumference portion of the drawing roller 21 and the releasing roller 23, the drawing and feeding of the next tape 40 can be carried out reliably.

[Explanation of the Tape Applicator Having the Driving Unit in the Lever]

Figure 15:
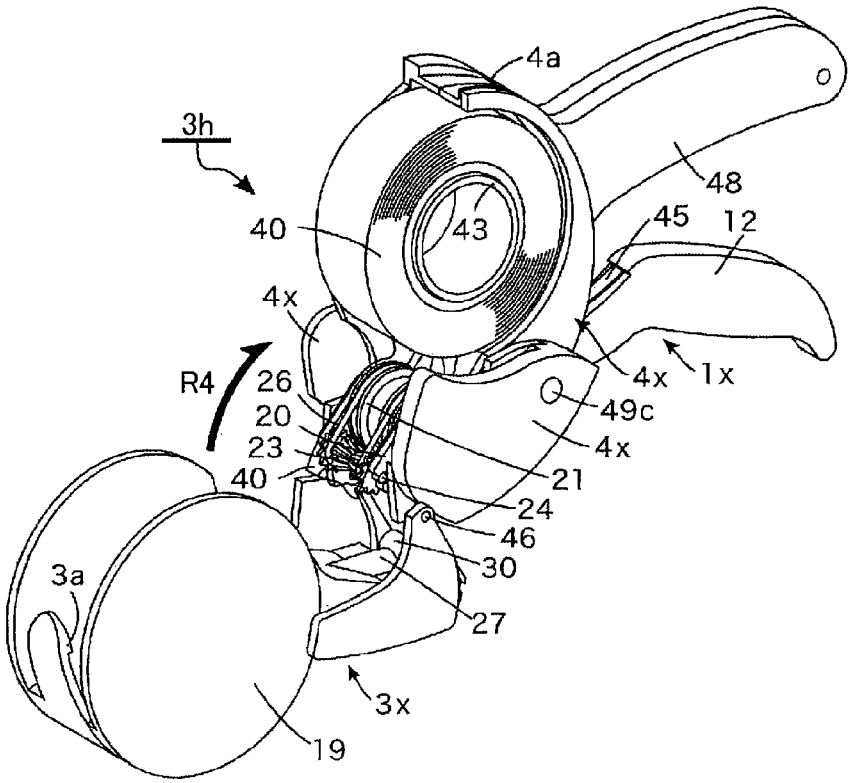
FIG. 15 is a perspective view showing an example of the development of the tape applicator of FIG. 13.

FIG. 15 is a perspective view showing an example of the operation of the tape applicator of FIG. 13. As shown in FIG. 15, the tape applicator 3*h* can be operated by rotating the application unit 3*x* forward of the chassis 4*x*. In such a developed state, the tape 40 in a roll shape is attached to the tape holding body 42, and the leading end of the tape 40 is drawn and is applied onto the outer circumference portion of the drawing roller 21 and the releasing roller 23. Thereafter, the application unit 3*x* is rotated about the shaft 46 in the direction indicated by an arrow R4 and is closed, and then, the hooking claw 3*a* of the application unit 3*x* is engaged with the opening/closing claw 4*a* of the chassis 4*x*. With such a configuration, the development of the tape applicator 3*h* can be carried out easily, and the replacement of the tape 40 and the initial setting of the tape 40 can be carried out easily and immediately.

In the tape applicator according to the fourth embodiment of the present invention, when the lever is closed, the leading end of the tape is fed and reserved onto the application target surface 1*a*, and, after the application of the tape is completed, the force of the lever is removed to open the lever, and the tape can be cut. Accordingly, the same effect as the second embodiment can be expected.

Other than the second to fourth embodiments, various driving methods such as rotating the driving unit by a dial can be used.

Fifth Advantageous Embodiment

[Cutting Portion with a Pressing Plate]

In the tape applicator of the second to fourth embodiments of the present invention, to carry out the cutting of the tape 40 more reliably, the cutting portion 5*x* may further include a pressing plate 5*b* that fixes the tape 40. The cutting portion with the pressing plate will be described below with reference to the tape applicator of the second embodiment.

Figure 16:
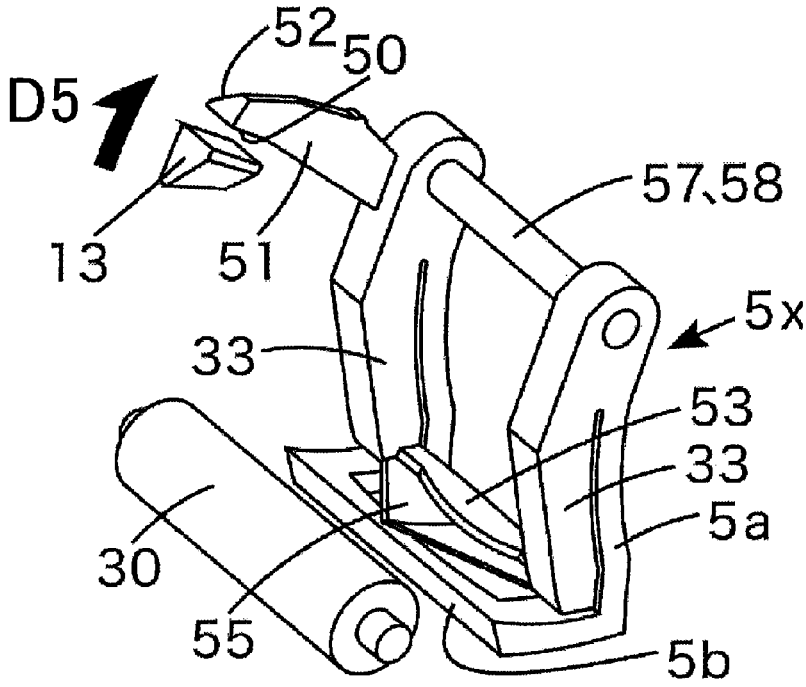
FIG. 16 is a perspective view showing an example of the arrangement of the cutting portion with a pressing plate, the driving claw, and an application roller.

FIG. 16 is a perspective view showing an example of the arrangement of the cutting portion with the pressing plate 5*b*, the driving claw 13, and the application roller 30. In the cutting portion 5*x* of the second embodiment, the cutting portion 5*x* further includes a spring body 5*a*, which performs biasing in the direction of the application roller 30, and the pressing plate 5*b* abutted onto the tape 40 before the cutting blade 55 at the end of the spring body 5*a*. The spring body 5*a* is disposed rearward of the arm 33 seen from the direction of the application roller 30, and the cutting blade 55 is arranged above the pressing plate 5*b* by directing the direction of the edge of the cutting blade 55 in the direction of the application roller 30. The arm claw 50 is disposed on the application roller side so that the arm claw 50 is engaged with the driving claw 13 from below, as indicated by an arrow D5 to rotate the cutting portion 5*x* about the swinging shaft 57 for moving the cutting blade 55 between the application roller 30 and the releasing roller 23. With such a configuration, the application roller 30 and the pressing plate 5*b* of the cutting portion 5*x* hold and fix the tape 40, and the edge of the cutting blade 55 of the cutting portion 5*x* is abutted onto the tape 40 against the biasing of the spring body 5*a*, thereby providing a tension to the tape 40 and cutting the tape 40.

Figure 17:
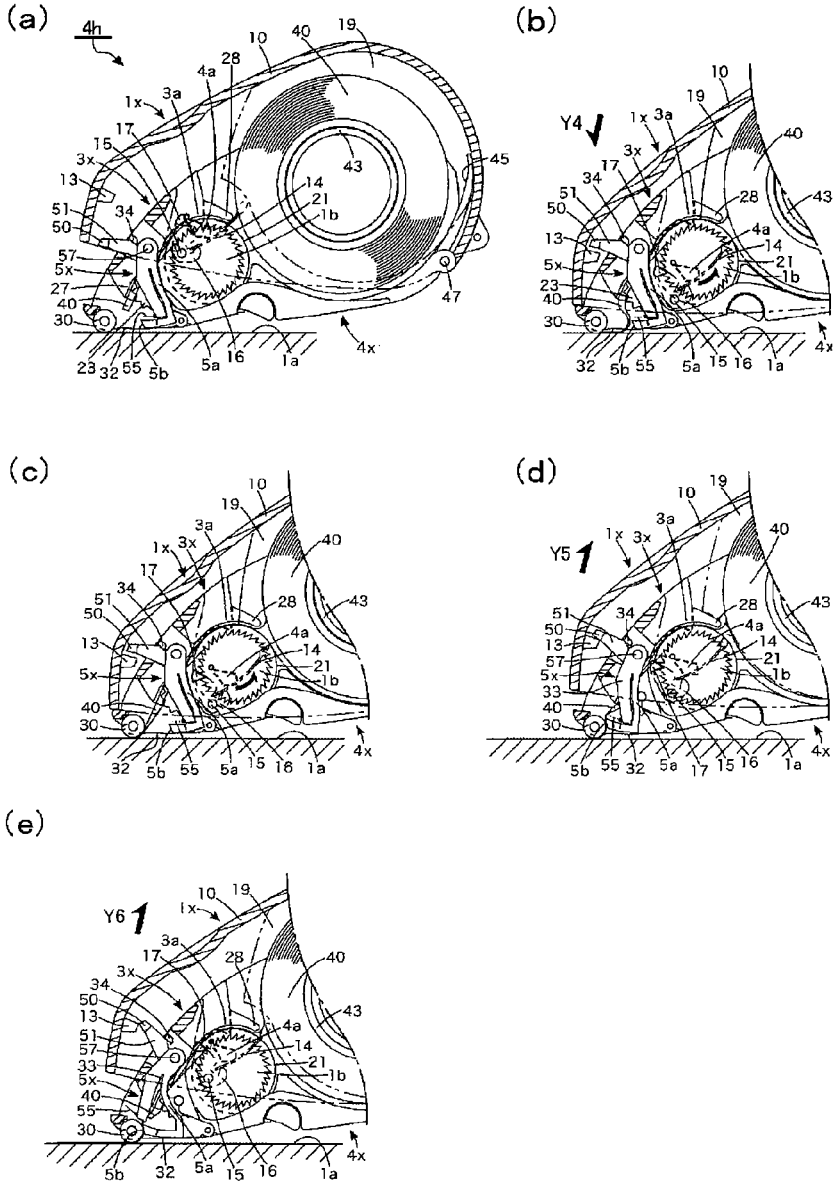
FIG. 17 is a diagram showing the operated state of the tape applicator of FIG. 1 having the cutting portion with the pressing plate of FIG. 16, in which FIG. 17(*a*) is a side view showing the whole tape applicator in which part of the case, the application unit, and the cutting portion is omitted, FIG. 17(*b*) is a side view showing part of the tape applicator after the feeding of the tape in FIG. 17(*a*), FIG. 17(*c*) is a side view showing part of the tape applicator after the application of the tape in FIG. 17(*a*), FIG. 17(*d*) is a side view showing part of the tape applicator after the fixing of the fed tape in FIG. 17(*a*), and FIG. 17(*e*) is a side view showing part of the tape applicator after the cutting of the tape in FIG. 17(*a*).

FIG. 17 is a diagram showing the operated state of the tape applicator of FIG. 1 having the cutting portion with the pressing plate of FIG. 16, in which FIG. 17(*a*) is a side view showing the whole tape applicator in which part of the case, the application unit, and the cutting portion is omitted, FIG. 17(*b*) is a side view showing part of the tape applicator after the feeding of the tape in FIG. 17(*a*), FIG. 17(*c*) is a side view showing part of the tape applicator after the application of the tape in FIG. 17(*a*), FIG. 17(*d*) is a side view showing part of the tape applicator after the fixing of the fed tape in FIG. 17(*a*), and FIG. 17(*e*) is a side view showing part of the tape applicator after the cutting of the tape in FIG. 17(*a*).

Since a tape applicator 4*h* basically performs the same operation as the tape applicator of the second embodiment, the application of the tape can be carried out by the same procedure. The procedure of applying the tape will be briefly described below. As shown in FIG. 17(*a*), first, the user presses the application roller 30 of the tape applicator 4*h* onto the application target surface 1*a*. Next, as shown in FIG. 17(*b*), when the case 10 is pressed in the direction indicated by an arrow Y4, similarly to the tape applicator of the second embodiment, the operating pawl 17 disposed to the driving transmission member 16 drives the tape feeding mechanism 2*x* and the leading end of the tape 40 is pressed onto the portion or region in which the application roller 30 and the application target surface 1*a* on the tape feeding mechanism 2*x* side come into contact with each other. The tape 40, which lacks a place to go, is flexed and reserved so that the adhesive surface makes contact with the application target surface 1*a*. Thereafter, as shown in FIG. 17(*c*), in the state that the case 10 is pressed, the whole tape applicator 4*h* is pulled in the desired direction to apply the tape 40. Thereafter, as shown in FIG. 17(*d*), the pressing of the case 10 is removed (that is, pressure on the case 10 is removed) to move the case 10 in the direction indicated by an arrow Y5. At this time, as shown in FIG. 17(*e*), the driving claw 13 of the case 10 is engaged with the arm claw 50 of the cutting portion 5*x* from below to lift the arm claw 50 in the upper direction indicated by an arrow Y6 against the biasing of the returning spring 34. Then, the cutting portion 5*x* is rotated in the clockwise direction about the swinging shaft 57, the application roller 30 and the pressing plate 5*b* of the cutting portion 5*x* hold the tape 40 to provide a tension to the tape 40, and the cutting blade 55 is abutted onto the tape 40 between the application roller 30 and the releasing roller 23 from the direction vertical to the moving direction of the tape 40 and from below the tape 40 to cut the tape 40. After the cutting of the tape 40, the driving claw 13 is moved to the direction of the terminal end of the arm claw 50, and when the engagement of the driving claw 13 and the arm claw 50 is removed, the cutting portion 5*x* is returned to its original position by the biasing of the returning spring 34.

The cutting portion of the fifth embodiment of the present invention can provide the tension to the tape between the application roller and the releasing roller to reliably carry out the cutting of the tape.

INDUSTRIAL APPLICABILITY

The tape feeding device according to the present invention can be used as the component of various tape applicators, desktop tape holders, electrically operated tape holders, sealing equipment, and packing devices. In addition, the tape applicator according to the present invention can be used for sealing envelops, affixing posters, attaching cards, and packing, and can further be used for various purposes. For example, the present invention can be used for an application of automatically applying a tape by a robot. Therefore, the industrial applicability by carrying out the present invention is significant.

Thus, generally, in accordance with the present invention, a tape applicator is provided that uses a tape feeding device that can smoothly and reliably hold a tape and perform a series of operations of feeding, applying, and cutting the tape with one hand. The tape applicator includes a tape feeding device including a substantially cylindrical drawing roller 21 rotated together with a tape 40, a releasing roller 23 for feeding the tape in the forward direction while releasing the tape together with the rotation of the drawing roller, and a belt 26 that couples the drawing roller and the releasing roller. Furthermore, the tape applicator includes a tape holding body 42 that holds the tape 40 and supports the tape feeding device, an application unit 3*x* that is supported by the tape holding body 42 and that causes the tape 40 to make contact with an application target surface 1*a*, a cutting blade 55 that is supported by the tape holding body 42 and that cuts the tape 40, and a case 10 that accommodates the tape holding body 42, wherein the leading end of the tape 40 is reserved in the released state.

DESCRIPTION OF REFERENCE SIGNS

1*h*, 2*h*, 3*h*, 4*h* Tape applicator
1*a* Application target surface
1*x* Driving unit

1*b* Ratchet wheel
10 Case
11 Pressing button
12 Lever
13 Driving claw
14 Returning spring
15 Driving shaft
16 Driving transmission member
17 Operating pawl
18 Stopper
19 Guide
2*x* Tape feeding mechanism
20 Roller holding portion
21 Drawing roller
22 Shaft
23 Releasing roller
24 Shaft
25 Belt groove
26 Belt
27 Propelling member
28 Tension body
3*x* Application unit
3*a* Hooking claw
30 Application roller
31 Shaft
32 Opening
33 Arm
34 Returning spring
4*x* Chassis
4*a* Opening/closing claw
40 Tape
41 Bottom plate
42 Tape holding body
43 Tape holding shaft
45 Operating spring
46 Shaft
47 Shaft
48 Handle
49 Protective cover
49*a* Accommodating portion
49*c* Shaft
5*x* Cutting portion
5*a* Spring body
5*b* Pressing plate
50 Arm claw
51 Plate spring arm
52 Cam
53 Cutting blade holding panel
54 Cutting button
55 Cutting blade
57 Swinging shaft
58 Strut

The invention claimed is:

1. A tape applicator comprising:

(a) a tape feeding device that feeds a tape wound around a shaft core in a forward direction, wherein the tape feeding device comprises (i) a substantially cylindrical drawing roller rotatable together with the tape, wherein the drawing roller includes a ratchet wheel rotated in the forward direction together with the drawing roller;

(ii) a releasing roller feeding the tape in the forward direction while the releasing roller releases a leading end of the tape by rotating together with the rotation of the drawing roller; and (iii) a belt that couples the drawing roller and the releasing roller;

(b) a tape holding body that rotationally holds the tape and supports the tape feeding device;

(c) an application unit that is supported by the tape holding body and that has an application roller for pressingly contacting the tape onto an application target surface and a cutting blade, wherein the cutting blade is arranged so as to be swingably moveable between the application roller and the drawing roller; and (d) a case that accommodates the tape holding body, wherein the leading end of the tape is reserved in a released state, and the case includes a driving unit including (i) a driving transmission member having an operating pawl engaged with teeth of the ratchet wheel;

(ii) a returning spring that biases the driving transmission member to promote engagement of the ratchet wheel and the operating pawl, and the driving transmission member is arranged sidewise in an axial direction of the ratchet wheel; and (iii) a driving claw disposed to drive the cutting blade so that the cutting blade cuts the tape when the driving unit is returned.

2. The tape applicator according to claim 1, wherein the driving unit comprises the driving claw, and the application unit comprises a cutting portion for cutting the tape, wherein the cutting portion comprises (i) a swinging shaft that is swingably supported by the application unit;

(ii) the cutting blade for cutting the tape; and (iii) arms for holding the cutting blade, wherein one arm has an arm claw engaged with the driving claw, and the cutting blade is arranged so as to be moveable between the application roller and the tape feeding device by swinging about the swinging shaft, wherein the cutting portion engages the driving claw with the arm claw when the driving unit is returned after driving of the tape feeding device, and a driving force for cutting the tape is obtained by the cutting blade.

3. The tape applicator according to claim 2, wherein the arm claw comprises a plate spring arm that is flexed and biased in a direction of the swinging shaft; and a cam that flexes the plate spring arm, wherein the driving claw flexes the plate spring arm and is slid and moved on the cam upon driving of the tape feeding device, and the driving claw is engaged with the arm claw after driving of the tape feeding device.

4. The tape applicator according to claim 2, wherein the arms support the cutting blade by both sides to form a space between the arms, and the cutting portion is disposed so as to be capable of passing the tape feeding device through the space and of swinging outside the tape feeding device.

5. The tape applicator according to claim 2, wherein the cutting portion further comprises:

(iv) a spring body that performs biasing in a direction of the application roller; and (v) a pressing plate that is abutted onto the tape before the cutting blade at an end of the spring body, wherein the spring body is disposed rearward of the arms as seen from the direction of the application roller, and the cutting blade is arranged above the pressing plate by directing a direction of an edge of the cutting blade in the direction of the application roller, and the cutting portion is arranged so that the pressing plate is abutted onto an outer circumference of the application roller by swinging about the swinging shaft.

* * * * *